US008661978B2

(12) United States Patent
Backhus et al.

(10) Patent No.: US 8,661,978 B2
(45) Date of Patent: Mar. 4, 2014

(54) NON-ENERGETICS BASED DETONATOR

(71) Applicant: Battelle Memorial Institute, Columbus, OH (US)

(72) Inventors: Roger F. Backhus, Plain City, OH (US); Richard W. Givens, Humble, TX (US); Jerome A. Klein, Raymond, OH (US); Ronald L. Loeser, Bexley, OH (US); Jason E. Paugh, Columbus, OH (US); Walter G. VanCleave, III, Pickerington, OH (US); Isaac Thomas Zimmer, Galena, OH (US)

(73) Assignee: Battelle Memorial Institute, Columbus, OH (US)

( * ) Notice: Subject to any disclaimer, the term of this patent is extended or adjusted under 35 U.S.C. 154(b) by 0 days.

(21) Appl. No.: 13/717,970

(22) Filed: Dec. 18, 2012

(65) Prior Publication Data

US 2013/0125772 A1 May 23, 2013

Related U.S. Application Data

(63) Continuation of application No. PCT/US2011/041003, filed on Jun. 17, 2011.

(60) Provisional application No. 61/356,424, filed on Jun. 18, 2010.

(51) Int. Cl.
*F42B 3/182* (2006.01)

(52) U.S. Cl.
USPC ..... 102/202.3; 102/200; 102/202.1; 102/206; 102/202.12

(58) Field of Classification Search
USPC ..... 102/200, 202.1, 202.3, 202.9, 202.12, 102/206, 202.5
See application file for complete search history.

(56) References Cited

U.S. PATENT DOCUMENTS 4,170,939 A * 10/1979 Hoheisel et al. ..... 102/202.3
4,369,707 A * 1/1983 Budde ..... 102/202.2
4,840,122 A 6/1989 Nerheim (Continued)

FOREIGN PATENT DOCUMENTS

WO 2010/048587 A1 4/2010

OTHER PUBLICATIONS

Notification of Transmittal of the International Search Report and the Written Opinion of the International Searching Authority for PCT Application No. PCT/US2011/041003, mailing date of Sep. 22, 2011; International Search Report and Written Opinion of the International Searching Authority, European Patent Office; Rijswijk, Netherlands.

*Primary Examiner* — Bret Hayes
*Assistant Examiner* — Derrick Morgan
(74) *Attorney, Agent, or Firm* — Thomas E. Lees, LLC

(57) ABSTRACT

A detonator system is provided for use with explosives that utilizes two subsystems. A first subsystem functions as a non-explosives based detonator, which does not contain any explosives. The second subsystem is an initiating subsystem, which includes an initiating pellet. To set off an explosive event, the non-energetics based detonator is coupled to the initiating subsystem and the non-energetics based detonator is commanded to provide a suitable signal to the initiating subsystem that is sufficient to function the initiating pellet. Further, the initiating subsystem can be integrated directly into an associated explosive such as a booster that has been configured to receive the initiator subsystem without changing the hazard class of the booster.

10 Claims, 21 Drawing Sheets

(56) References Cited

U.S. PATENT DOCUMENTS

| | | | | |
|---|---|---|---|---|
| 4,869,171 | A | 9/1989 | Abouav | |
| 4,904,196 | A * | 2/1990 | Sueyoshi et al. | 439/188 |
| 5,291,828 | A | 3/1994 | Nerheim et al. | |
| 5,314,345 | A * | 5/1994 | Cahaly et al. | 439/188 |
| 5,509,817 | A * | 4/1996 | Tsuji | 439/188 |
| 5,647,757 | A * | 7/1997 | Chrysostomou | 439/352 |
| 5,733,135 | A * | 3/1998 | Kennedy et al. | 439/188 |
| 5,746,618 | A * | 5/1998 | Gauker | 439/352 |
| 5,857,857 | A * | 1/1999 | Fukuda | 439/188 |
| 5,944,545 | A * | 8/1999 | Willhelm et al. | 439/188 |
| 5,969,286 | A | 10/1999 | Ward et al. | |
| 6,056,314 | A * | 5/2000 | Shirk et al. | 280/728.2 |
| 6,213,800 | B1 * | 4/2001 | Mramor | 439/188 |
| 6,234,081 | B1 | 5/2001 | Neyer | |
| 6,385,031 | B1 | 5/2002 | Lerche et al. | |
| 6,655,289 | B1 | 12/2003 | Bornheim et al. | |
| 6,659,010 | B2 | 12/2003 | Goernig et al. | |
| 6,781,813 | B1 | 8/2004 | Bornheim et al. | |
| 6,851,370 | B2 | 2/2005 | Reynolds et al. | |
| 6,923,122 | B2 | 8/2005 | Hennings et al. | |
| 6,977,468 | B1 | 12/2005 | Baginski | |
| 7,363,860 | B2 | 4/2008 | Wilson et al. | |
| 7,571,679 | B2 | 8/2009 | Nance | |
| 7,581,496 | B2 | 9/2009 | Hennings et al. | |
| 7,690,303 | B2 | 4/2010 | Reynolds et al. | |
| 7,748,322 | B1 | 7/2010 | Reynolds et al. | |
| 7,866,264 | B2 | 1/2011 | Nance | |
| 7,921,774 | B1 | 4/2011 | Reynolds et al. | |
| 8,091,477 | B2 | 1/2012 | Brooks et al. | |
| 8,230,788 | B2 | 7/2012 | Brooks et al. | |
| 8,485,097 | B1 * | 7/2013 | Nance et al. | 102/202.7 |
| 2004/0043652 | A1 * | 3/2004 | Edwards | 439/188 |
| 2004/0112244 | A1 * | 6/2004 | Barker et al. | 102/530 |
| 2010/0055968 | A1 * | 3/2010 | Brown | 439/378 |

* cited by examiner

MALE HALF

FEMALE HALF

MATED HALVES

MALE HALF

FEMALE HALF

MATED HALVES

GIVEN THE DESIRE DIRECTION OF MOVEMENT, THE COMPUTER DESIGNES THESE HOLES FIRST IN THE FIRING SEQUENCE.

NON-ENERGETICS BASED DETONATOR

CROSS REFERENCE TO RELATED APPLICATIONS

This application is a continuation of International Application No. PCT/US2011/041003, filed Jun. 17, 2011, entitled "NON-ENERGETICS BASED DETONATOR", which claims the benefit of U.S. Provisional Patent Application Ser. No. 61/356,424, filed Jun. 18, 2010, entitled "NON-ENERGETICS BASED DETONATOR", the disclosures of which are hereby incorporated by reference.

BACKGROUND

The present invention relates to detonators, and more particularly, to non-energetics-based detonators, detonator systems using non-energetics based detonators and methods of detonating explosives.

In various industries, such as mining, construction and other earth moving operations, it is common practice to utilize detonators to initiate explosives loaded into drilled blast holes for the purpose of breaking rock. For instance, commercial electric and electronic detonators are conventionally implemented as hot wire igniters that include a fuse head as the initiating mechanism to initiate a corresponding explosive. Such hot wire igniters operate by delivering a low voltage electrical pulse to the fuse head, causing the fuse head to heat up. Heat from the fuse head, generated in response to the low voltage electrical pulse, initiates a primary explosive, e.g., lead azide, which, in turn, initiates a secondary explosive output pellet, such as pentaerythritol tetranitrate (PETN) at an output end of the detonator. However, conventional hot wire igniters must rely on an extremely sensitive primary explosive to transition the detonation process from the fuse head to the corresponding explosive output pellet. Moreover, it is possible that the voltage and power requirements to function this type of conventional hot wire igniter may be encountered from inadvertent sources like static, stray currents and radio frequency (RF) energy.

Another exemplary detonator type is referred to as an exploding bridgewire detonator (EBW). The EBW includes a short length of small diameter wire that functions as a bridge. In use, explosive material beginning at a contact interface with the bridge wire transitions from a low density secondary explosive pellet to a high density secondary explosive pellet at the output end of the detonator. To initiate a detonation event, a high voltage pulse is applied in an extremely short duration across the bridge wire causing the small diameter wire to explode. The shockwave created from the bridge wire's fast vaporization initiates the low density secondary explosive pellet, such as PETN, which in turn initiates the high density secondary explosive pellet such as cyclotrimethylene trinitramine (RDX), at the output end of the EBW.

Yet another exemplary detonator type is referred to as an exploding foil initiator (EFI). A conventional EFI includes a thin metal foil having a defined narrow section. A polymer film layer is provided over the metal foil. To initiate a detonation event, a high voltage, very short pulse of energy is applied across the metal foil to cause the narrow section of the metal foil to vaporize. As the narrow section of the metal foil vaporizes, plasma is formed as the vaporized metal cannot expand beyond the polymer film layer. The pressure created as a result of this vaporization action builds until the polymer film layer is compromised, thus triggering a shock wave that initiates the detonation a connected explosive device.

BRIEF SUMMARY

According to various aspects of the present invention, a detonator for initiating a detonation event comprises a non-energetics based subsystem that is free of explosive material, and an initiating subsystem. The non-energetics based subsystem is selectively mated together with the initiating subsystem to form a detonator. There are several exemplary configurations to implement the above, two-subsystem detonator device.

According to aspects of the present invention, the non-energetics based subsystem comprises a controller, a low voltage to high voltage converter controlled by the controller, a primary energy source coupled to the low voltage to high voltage converter, a secondary energy source controlled by the controller and a first interface. The first interface includes a first pair of conductive contacts spaced by an insulator, where each of the conductive contacts of the first pair is electrically coupled to a circuit path associated with the primary energy source.

The initiating subsystem comprises a high voltage switch, an initiator electrically coupled in series with the high voltage switch, an initiating pellet positioned in cooperation with the initiator, and a second interface. The initiating pellet has explosive material comprising at least one insensitive secondary explosive material. However, the explosive material is free of sensitive primary explosive material. Moreover, the initiating pellet is positioned such that functioning the initiator detonates the explosive material of the initiating pellet. The second interface mates with the first interface to electrically connect a first conductive path from the primary energy source to the circuit of the high voltage switch and initiator. The second interface including a first pair of interface legs positioned so that each interface leg of the first pair mates with a corresponding one of the first pair of conductive contacts of the first interface when the initiating subsystem is suitably mated with the non-energetics based subsystem.

The interface legs of the second interface are self-shunting and thus short to one another when the initiating subsystem is removed from the non-energetics based subsystem. Further, the insulator of the first interface is arranged so as to separate the self-shunting legs and guide each leg to a corresponding one of the conductive contacts when the non-energetics based subsystem is suitably assembled with the initiating subsystem by mating the first interface with the second interface.

Moreover, in a further embodiment, the first interface of the non-energetics based subsystem further comprises a second pair of conductive contacts spaced by the insulator, where each of the conductive contacts of the second pair is electrically coupled to a circuit path associated with the secondary energy source. Correspondingly, the second interface of the initiating subsystem comprises a second pair of interface legs positioned so that each interface leg of the second pair mates with a corresponding one of the second pair of conductive contacts of the first interface when the initiating subsystem is suitably mated with the non-energetics based subsystem and the second interface couples to a control element of the switch.

According to further aspects of the present invention, a detonator for initiating a detonation event comprises a non-energetics based subsystem that is free of explosive material, having a controller, a low voltage to high voltage converter controlled by the controller, a primary energy source coupled to the low voltage to high voltage converter, and a secondary energy source controlled by the controller. An initiating subsystem that is selectively coupled or uncoupled from the non-energetics based detonator, comprises an initiating pellet having explosive material comprising at least one insensitive secondary explosive material, wherein the explosive material is free of sensitive primary explosive material, a high voltage switch having a control element and an initiator electrically coupled with the high voltage switch, wherein the high voltage switch and initiator are coupled to a select one of the non-energetics based subsystem and the initiating subsystem and a booster of explosive material having a detonation well, wherein the initiating subsystem is positioned within the detonation well such that the non-energetics based subsystem mates with the initiating subsystem by inserting the non-energetics based subsystem into the detonation well.

According to still further aspects of the present invention, a detonator for initiating a detonation event when utilized with a booster that provides an initiating subsystem having an initiating pellet installed in a detonation well thereof, comprises a non-energetics based subsystem that is free of explosive material, having a housing having a cross-section that generally corresponds the cross section of the associated booster, the housing having at least one through passageway that passes through the housing, and which aligns substantially in register with a corresponding through tunnel of the booster. The detonator further comprises an extension extending from the housing having a dimension and position along the housing that aligns substantially in register with the detonation well of the booster, a controller contained within the housing, a low voltage to high voltage converter coupled the controller, a primary energy source coupled to the low voltage to high voltage converter, a secondary energy source, a first interface electrically coupled to the primary energy source and an initiator positioned at the distal end of the extension that is coupled to the primary energy source via a high voltage switch. The non-energetics based subsystem mates with the booster such that the extension extends into the detonator well of the booster so as to bring the initiator in register with the initiating pellet pre-installed in the detonator well.

According to yet further aspects of the present invention, a computer network box for commanding a blasting operation, comprises a network box having a first side, a second side, a third side and a fourth side, the network box for positioning at a hole of a plurality of holes in an associated blast pattern. The first side has at least one connector, each first side connector for linking an associated downhole detonator downline to connect a corresponding detonator to the network box, and at least one additional connector for coupling out to another network box positioned in a next row of holes if a next row of holes is in the blast pattern. The second side has a connector for linking in from another network box associated with an adjacent row of holes if an adjacent row of holes is included in the blast pattern. The third side comprises at least one connector for linking in from yet another network box associated with a previous sequential hole in a row of holes if a previous sequential hole is in the blast pattern. Moreover, the fourth side comprises at least one connector for linking out to a next network box associated with a next sequential hole in a row of holes if a next sequential hole is in the blast pattern.

According to yet further aspects of the present invention, a computer network system for commanding a blasting operation, comprises a plurality of network boxes, each box for positioning at a corresponding hole in a blast operation, each network box comprising a first side, a second side, a third side and a fourth side, that is positioned at a hole of a plurality of holes in an associated blast pattern. The first side has at least one connector, each first side connector for linking an associated downhole detonator downline to connect a corresponding detonator to the network box, and at least one additional connector for coupling out to another network box positioned in next row of holes if a next row of holes is in the blast pattern. The second side has a connector for linking in from another network box associated with an adjacent row of holes if an adjacent row of holes is included in the blast pattern. The third side comprises at least one connector for linking in from yet another network box associated with a previous sequential hole in a row of holes if a previous sequential hole is in the blast pattern. Moreover, the fourth side comprises at least one connector for linking out to a next network box associated with a next sequential hole in a row of holes if a next sequential hole is in the blast pattern.

The computer network system further comprises a blasting computer for connection to a select one of the network boxes, the blasting computer configured to execute a software positioning algorithm that identifies a detonator attached to each first side connector of each network box, compute a detonator firing time for each detonator attached to each first side connector of each network box, transmit the fire time to each detonator attached to each first side connector of each network box and initiate a detonation event to detonate each detonator according to its preprogrammed fire time.

DETAILED DESCRIPTION

Figure 2:
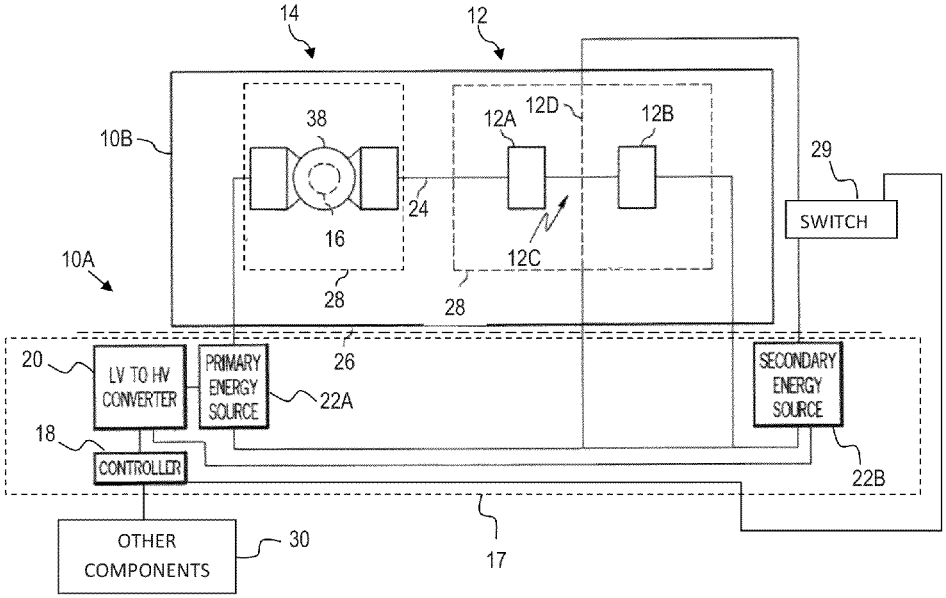
FIG. 2 is a schematic illustration of select components of a two-component detonator system where the two components are connected together, according to various aspects of the present invention.
Figure 3:
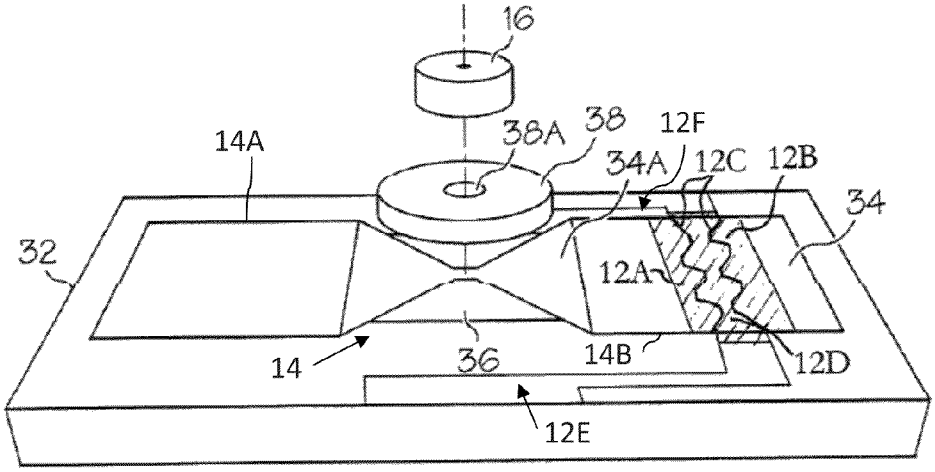
FIG. 3 is a schematic illustration of an initiator and a switch for a two-component detonator system according to various aspects of the present invention.

According to various aspects of the present invention, a two-component detonator device for use with explosives comprises two subsystems. A first subsystem functions as a fireset and does not contain any explosives. The second subsystem includes an initiating pellet that is capable of directly firing an insensitive secondary explosive material. Moreover, the two subsystem detonator device may be implemented in "basic" detonator configurations or in "enhanced" detonator configurations, according to various aspects of the present invention, as described more fully herein. The discussion herein with reference to FIGS. 1 through 3 is applicable to both basic and enhanced detonator implementations.

Two-Component Detonator Overview

Figure 1:
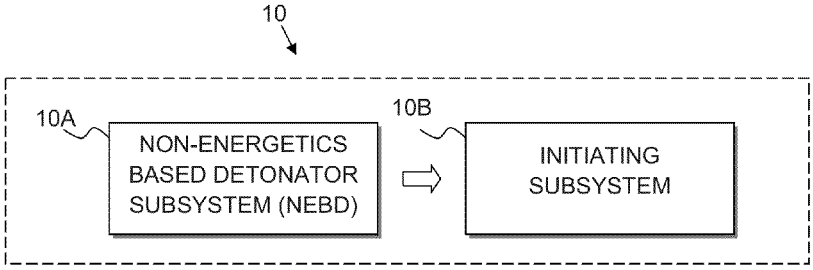
FIG. 1 is a schematic block diagram of a two-component detonator system according to various aspects of the present invention.

Referring now to the drawings and in particular to FIG. 1, a detonator device 10 according to various aspects of the present invention includes two subsystems, including a non-energetics based subsystem 10A (also referred to herein as a non-energetics based detonator or "NEBD" 10A) and an initiating subsystem 10B. The NEBD 10A includes controls and/or electronics, including a high power conversion unit (HPCU) capable of locally generating the power required to function an initiation event. However, the NEBD 10A itself does not contain explosives. In this regard, the NEBD 10A functions as a fireset. The initiating subsystem 10B includes an explosive, e.g., an insensitive secondary explosive that is capable of initiating a detonation event with a corresponding explosive device. An initiator may be integrated with either the NEBD 10A or the initiating subsystem 10B, as will be described in greater detail herein.

In operation, when the NEBD 10A is properly coupled to the initiating subsystem 10B and an appropriate command is given to the NEBD 10A, the HPCU of the NEBD 10A generates the power required to function the initiator, which in turn, initiates the initiating pellet of the initiating subsystem 10B.

The Detonator Device

Referring to FIG. 2, select components of a detonator device 10 are illustrated according to various aspects of the present invention. As schematically illustrated, a NEBD 10A is mated with a corresponding initiating subsystem 10B (depicted in a solid box to distinguish from components of the NEBD 10A). Referring initially to the initiating subsystem 10B, a high voltage switch 12 is electrically connected in series with an initiator 14 and an initiating pellet 16 is positioned in cooperation with the initiator 14.

The High Voltage Switch

The high voltage switch 12 is designed to hold off stray signals from triggering the initiator 14, e.g., signals that are not valid actuation signals, even if the stray signals are themselves relatively high voltage signals. In this regard, the high voltage switch 12 is preferably triggered by an actuation signal comprising a voltage that is significantly greater than the voltage associated with common electronic components that may be proximate to the initiating subsystem 10B, thus providing a level of redundancy to the detonator device 10.

As illustrated, the high voltage switch 12 includes a first contact 12A and a second contact 12B that define the switch contacts, which are separated from each other by a gap 12C. Additionally, a trigger element 12D is disposed within the gap 12C between and electrically isolated from the first contact 12A and the second contact 12B. In its default state, the trigger element 12D is electrically isolated from the first contact 12A and the second contact 12B. Moreover, in its default state, the first contact 12A and second contact 12B are electrically isolated from one another, forming an open circuit there between.

The Initiator

According to aspects of the present invention, the initiator 14 is coupled in series to the high voltage switch 12. By way of illustration, and not by way of limitation, the initiator 14 may comprise a fusehead, an exploding bridgewire device (EBW) or an exploding foil initiator (EFI). In the illustrative implementation, the initiator 14 is implemented as an EFI that is functioned to initiate a corresponding initiating pellet 16 as will be described in greater detail herein. The high voltage switch 12 and the initiator 14 may be co-located, e.g., provided on a single integrated circuit (IC) chip, such as where the initiator is implemented as one or more EFIs. Alternatively, the high voltage switch 12 and the initiator 14 may be provided separately, e.g., on separate IC chips or other suitable substrates that are electrically interconnected together. Still further, the switch 12 and initiator 14 may be split across components of the detonator device 10, e.g., such that the switch 12 is provided with the NEBD 10A, and the initiator 14 is provided with the initiating subsystem 10B.

The Initiating Pellet

According to aspects of the present invention, the initiating pellet 16 is comprised of at least one high density insensitive secondary explosive material. However, the initiating pellet 16 does not include a sensitive primary explosive. In an illustrative example, the initiating pellet 16 is implemented as a single pellet of Hexanitrostilbene (HNS-IV). As another illustrative example, the initiating pellet 16 is implemented as a combination pellet that includes a first insensitive secondary explosive such as HNS-IV, at least in an area of anticipated impact from an EFI-based initiator 14, and a second (output) insensitive secondary explosive such as a high brisance, insensitive secondary explosive that possesses considerably more shock energy than HNS-IV alone, in the remainder of the pellet. Exemplary high brisance insensitive secondary explosives comprise Composition A5, PBXN-5, etc.

The combination of HNS-IV and a high brisance secondary provides combined insensitive explosives that are much less sensitive than those found in conventional commercial detonators, which typically require a sensitive primary explosive to initiate a sensitive secondary explosive such as pentaerythritol tetranitrate (PETN). Such primary explosives required by conventional detonators are extremely sensitive to shock, friction, and/or static electricity. However, the initiating pellet 16 described herein, acts as a built in booster for the detonator device 10, allowing direct initiation of very insensitive explosive devices and blasting agents.

Micro-Fabricated Switch and Initiator

In exemplary embodiments of the present invention, micro-fabrication techniques, e.g., Metallic Vacuum Vapor Deposition (MVVD), are utilized to integrate the high voltage switch 12 with the initiator 14 onto a ceramic or silicon substrate. In an exemplary implementation, the high voltage switch 12 and/or the initiator 14 are manufactured utilizing a Metallic Vacuum Vapor Deposition (MVVD) process.

In an illustrative implementation, the high voltage switch 12 is implemented as a planar switch connected to the initiator 14. The initiator 14 is separated from the high voltage switch 12 by a board trace or wire 24 such that the high voltage switch 12 and the initiator 14 are two separate components on the same board or chip 26. An insulating material 28, e.g., a polyimide film such as Kapton, is optionally provided over the high voltage switch 12, the initiator 14, the trigger wire 24, or portions thereof (as shown as the dashed boxes). Kapton is a trademark of E.I. du Pont de Nemours and Company. The insulating material 28 allows the high voltage switch 12 to hold off a high voltage and improves reliability of the high voltage switch 12 by providing a tighter tolerance to the hold off voltage and/or by providing a tighter tolerance to the voltage required to close the switch contacts relative to a conventional gap, e.g., found in a conventional spark gap device.

To trigger the initiating pellet 16, the high voltage switch 12, which is in a normally open state, is actuated to transition the high voltage switch 12 from the normally open state to a closed state. For example, to actuate the switch 12, a voltage is applied to the trigger element 12D that is sufficient to cause the first contact 12A and the second contact 12B to short together. Additionally, a suitable voltage is applied across the series circuit of the high voltage switch 12 and the initiator 14. In this regard, the initiating pellet 16 is positioned relative to the initiator 14 such that functioning the initiator 14 detonates the explosive material of the initiating pellet 16 to produce a primary explosion. This primary explosion is typically utilized to detonate another explosive device or product that is positioned proximate to the detonator device 10, e.g., a commercial booster as will be explained in greater detail herein.

High Power Conversion Unit

The NEBD 10A utilizes an integral high power conversion unit (HPCU) 17 to generate the high voltage required to function the initiator 14, which in turn, initiates the initiating pellet 16 provided with the initiating subsystem 10B. In an exemplary implementation, the HPCU 17 converts a low voltage, e.g., 12V, into a high voltage, e.g., in excess of 1,000V, capable of producing megawatts of power. Moreover, because the HPCU 17 of the NEBD 10A delivers the high power to the initiator 10B, a requirement of conventional detonators to transmit high power across long distances is eliminated.

In the illustrative example, the HPCU 17 is implemented in general, by a circuit that includes a controller 18, at least one low voltage to high voltage converter 20, a primary energy source 22A and a secondary energy source 22B. The low voltage to high voltage converter 20 is coupled between the controller 18 and the primary energy source 22A. The primary energy source 22A further forms a circuit with the high voltage switch 12 and the initiator 14. The low voltage to high voltage converter 20 is also coupled to the secondary energy source 22B as illustrated. The secondary energy source 22B forms a circuit with the trigger element 12D of the switch 12.

The controller 18 selectively controls the low voltage to high voltage converter 20 at an appropriate time to charge the primary energy source 22A to a voltage suitable for functioning the initiator 14. Correspondingly, the controller 18 selectively controls when the secondary energy source 22B is charged to a voltage sufficient to operate the switch 12.

An actuation signal, e.g., initiated by the controller 18 triggers the low voltage to high voltage DC-DC converter 20 to charge the secondary energy source 22B, such as a high voltage capacitor. To close or otherwise activate the high voltage switch 12, the secondary energy source 22B is discharged, driving a current through the trigger element 12D. The discharged current is sufficient to electrically short the first contact 12A and 12B. For instance, switch closure may result from breaking down the dielectric that separates the first and second switch contacts 12A and 12B from the trigger element 12D. Alternatively, the trigger element may short the first and second switch contacts 12A, 12B as a result of vaporization, melting or otherwise passing current through the trigger element 12D.

In another illustrative example, to close or otherwise activate the high voltage switch 12, the primary energy source 22A in a primary circuit is applied across the first contact 12A and second contact 12B of the high voltage switch 12. For example, the primary energy source 22A, implemented as a primary capacitor, is charged to a high voltage, e.g., 1,000 volts or greater. The potential of the primary capacitor is coupled to the first contact 12A, e.g., through the initiator 14. The second contact 12B is referenced to ground or other reference associated with the primary energy source 22A. Because the first contact 12A is electrically isolated from the second contact 12B, no current will flow between the first contact 12A and second contact 12B, and thus, no current flows through the initiator 14. However, because of a potential difference between the first contact 12A and second contact 12B, an electric field is formed with sufficient strength to cause ions to migrate towards the gap 12C. When the secondary energy source 22B is applied to the trigger element 12D, a current is driven through the trigger element 12D that is sufficient to cause the migrating ions to arc across the gap 12C and create a conductive path between the first contact 12A and the second contact 12B, thus functioning the initiator 14.

The implementation of the initiator 14 as an EFI chip arrangement as described in greater detail herein improves accuracy and reliability of the initiator compared to conventional EFI structures. Accordingly, the improved reliability and accuracy of this detonator may find many uses in commercial and defense applications. These potential applications range from rock blasting for military and commercial demolition to use as a high precision/high capability research tool.

Miscellaneous Aspects to Detonator Overview

In alternative arrangements to that described above, the secondary energy source 22B receives its voltage by bleeding down voltage from the primary energy source 22A. In further alternative embodiments, the secondary energy source utilizes its own low voltage to high voltage converter to generate the necessary signal required to close the high voltage switch 12. Further, in illustrative embodiments, an electronic switch 29 such as a field effect transistor is controlled by a suitable control signal from the controller 18 to selectively couple the secondary energy source 22B to the trigger element 12D. In this regard, the electronic switch 29 may be positioned on the low voltage side, e.g., before a low voltage to high voltage converter, or the electronic switch may be positioned between the secondary energy source and the trigger electrode 12D, as illustrated.

According to various aspects of the present invention, the high voltage switch 12 is configured to hold off the high voltage required to function the initiator 14. For example, the initiator 14 may be implemented as a single EFI. Moreover, the initiator 14 may be implemented as an array of EFIs, which require relatively higher voltages than even a single EFI to fire. In this regard, the characteristics of the high voltage switch(es) 12 and/or initiator(s) are custom microfabricated according to the requirements associated with a particular implementation of the detonator device 10.

According to further aspects of the present invention, the NEBD 10A comprises further component(s) 30, e.g., coupled to the controller 18. By way of illustration, the components 30 may include timing circuitry, communication circuitry, etc. As noted above, various aspects of the present invention may implement the detonator device 10 in various configurations, such as a basic configuration and an enhanced configuration. In this regard, an enhanced configuration differentiates from a basic configuration by providing additional features, such as induction based communication capabilities and powering electronics, a global positioning system (GPS), an identification system, such as using radio frequency identification (RFID) technology and/or other systems for facilitating efficient deployment of the detonator device 10 in the field, as will be described in greater detail herein.

EFI—Switch Integration onto a Substrate

Referring to FIG. 3, an EFI-based implementation of the initiator 14 includes an alumina substrate 32 that forms a base layer. A bridgefoil 34 having a narrow channel 34A is provided on the alumina substrate 32. Moreover, the bridgefoil 34 is electrically coupled to an energy source, e.g., a high voltage capacitor, via the switch 12, which is described in greater detail with reference to FIG. 2. A flyer layer 36, e.g., a polyimide film material such as Kapton is positioned over at least the narrow channel 34A of the bridgefoil 34, and a barrel 38 having a through aperture 38A is positioned over the Kapton flyer layer 36. Still further, the barrel 38 is positioned proximate to the initiating pellet 16.

The barrel 38 comprises, for example, a polyimide film material such as Kapton. In an exemplary embodiment, the flyer layer 36 and the barrel 38 are formed as part of the micro-fabrication of the initiator 14, e.g., directly deposited onto the EFI chip during the fabrication process, or the barrel 38 and/or flyer layer 36 may be otherwise provided. As such, although illustrated as separate components for purposes of illustration, the barrel 38 may be integrated with the flyer layer 36, bridgefoil 34 and substrate 32.

In this arrangement, the initiating pellet 16 is positioned adjacent to the barrel 38 during assembly. Alternatively, the initiator 14 is provided as part of the NEBD 10A. Under this arrangement, the initiator 14 is positioned proximate to the initiating pellet 16 when the NEBD 10A is suitably mated with its corresponding initiating subsystem 10B.

In operation, when a suitable initiation signal is applied to the initiator 14, for example, an extremely high power (megawatts) electrical pulse, the bridgefoil 34, including the small metal bridge located in the center of the EFI chip, is vaporized into plasma. In response, a "flyer" disk is cut or otherwise torn free from the flyer layer 36 on the chip surface by the plasma pressure within the area under the through aperture 38A of the barrel 38. The flyer disk, such as a thermoset polyimide in the above example, is accelerated along the through aperture 38A of the barrel 38 so as to impact the initiation pellet 16 with sufficient shock to directly initiate the pellet 16 and thus set off the designed explosion.

EFI-based initiators require typical operational voltages of 800 V to 2,000 V. The peak power required to launch the flyer with sufficient momentum to initiate the impacted explosives is in the megawatts range. However, the illustrated EFI can directly initiate a high density, insensitive secondary explosive. Thus, no extremely sensitive primary or sensitive low density secondary explosives are required for initiation.

In the illustrated example, the initiator 14 has a first contact 14A (illustrated to the left of the bridgefoil 34A) and a second contact 14B (illustrated to the right of the bridgefoil 34A). The first contact 12A of the high voltage switch 12 is in series with second contact 14B of the initiator 14. Thus, a primary, series circuit is provided between first contact 14A of the initiator 14 and the second contact 12B of the high voltage switch 12. A secondary circuit is provided with the trigger element 12D, which is disposed within the gap 12C so as to be normally electrically isolated from the first contact 12A and the second contact 12B of the switch 12.

The trigger element 12D comprises, for example, a wire or trace that is imbedded between the first contact 12A and second contact 12B. In the illustrated implementation, the trigger element 12D has a predetermined, non-linear shape configured to achieve a desired hold off voltage and/or a desired triggering voltage. More particularly, the trigger element 12D is formed between the first and second contacts 12A, 12B of the high voltage switch 12, and has a faceted geometry that spaces the trigger element 12D from the first contact 12A and the second contact 12B. For instance, as illustrated, the faceted configuration of the trigger element 12D comprises a repeating pattern of a widened portion adjacent to a narrowed. The pattern of the trigger element 12D may also and/or alternatively be implemented as a repeating row of butterfly banded regions where the width of the trigger element repeatedly narrows into a channel shape, then funnels out to a wider shape. The pattern of the trigger element 12D may also be non-linear, serpentine, saw toothed, ramped jagged or otherwise configured to achieve a desired hold off voltage.

In the illustration, the gap 12C defines an isolation region and is depicted by the thickness of the lines that define the boundary between the first contact 12A and the trigger element 12D, and the boundary between the second contact 12B and the trigger element 12D. A dielectric material may be used to fill the gap 12C and/or to generally overlie the switch components 12A, 12B, 12C, 12D e.g., as schematically represented by the illustrated shading in the exemplary implementation. A pair of switch lands 12E, 12F enable coupling of the secondary energy source to the trigger element 12D of the high voltage switch 12 when implemented on a chip substrate.

The detonators 10 described more fully herein, comprise built in "safe" and "arm" systems via integration of a high voltage switch 12 with an initiator 14, and via separate circuitry for closing the high voltage switch 12 and for functioning the initiator 14, as described more fully herein. Moreover, the switch chip circuitry of the high voltage switch 12 and initiator 14 offers a robust, redundant system, which receives power locally generated by the corresponding NEBD 10A.

Two-Component Detonator in a Conventional Form Factor (The Basic Detonator)

Figure 4A:
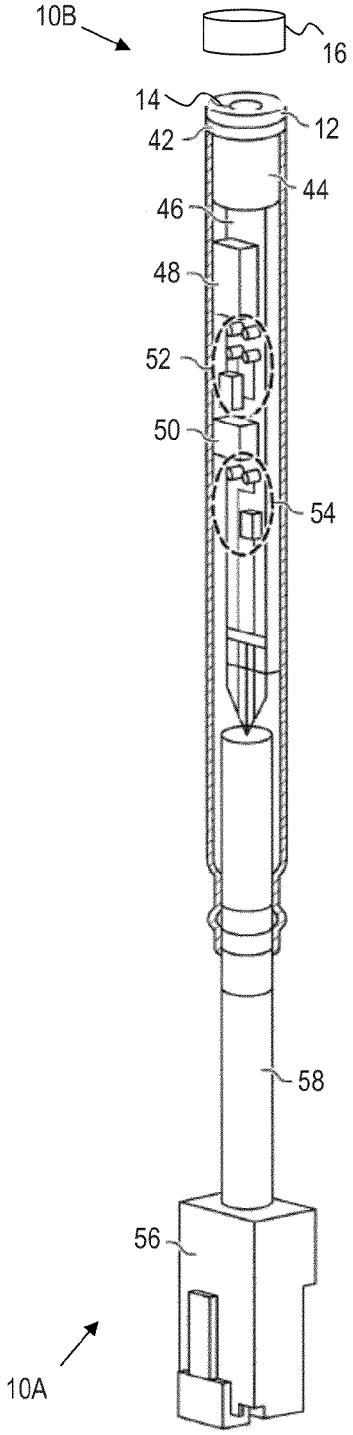
FIG. 4A is a schematic illustration of a two-component detonator system according to various aspects of the present invention.

Referring to FIG. 4A, the detonator device 10 is provided in a package that resembles the general form factor, i.e., general shape and dimensions, of a conventional detonator configuration (standard cap configuration as illustrated). This approach enables use of the detonator device 10 with the myriad of explosive products that exist in the product lines of explosives manufacturers, while offering significant technical advancements in operational use and performance over conventional detonators.

In the illustrative implementation, the initiating subsystem 10B comprises an initiating pellet 16. The NEBD 10A comprises a header 42, a header socket 44, connections 46, a primary energy source 48, a secondary energy source 50, a controller 52, a low voltage to high voltage converter 54, a detonator connector 56 and a connecting cable 58. The header 42 connects to the header socket 44 and supports a high voltage switch 12 and an initiator 14, e.g., as described previously with reference to FIGS. 2 and 3.

Particularly, a primary circuit is formed, which electrically connects the primary energy source 48 (e.g., a primary high voltage capacitor) to a series circuit that connects the high voltage switch 12 in series with the initiator 14, via conductive paths provided by the connections 46, header socket 44 and header 42. For instance, the primary circuit couples between the first contact 14A of the initiator 14 and the second switch contact 12B of the high voltage switch 12, as illustrated in FIG. 3. Similarly, the secondary energy source 50, such as a secondary capacitor (also referred to herein as a switch capacitor) selectively couples to the trigger element of the high voltage switch 12 (e.g., which couples to the switch lands 12E, 12F of the high voltage switch 12 on the switch chip as illustrated in FIG. 3) via additional conductive paths provided by the connections 46, header socket 44 and header 42. An electronic switch is optionally disposed between the secondary energy source 50 and the trigger element of the switch 12, e.g., in a manner analogous to the switch 29 described with reference to FIG. 2.

The controller 52 is used to program the detonator device 10, for a given application, e.g., to set and/or control a desired firing time. The controller 52 includes control electronics such as a microprocessor, timing circuitry, switching circuitry, diagnostic circuitry, etc., to control a low voltage to high voltage converter 54, bleed down components, and other electronics that selectively charge the primary energy source 48 and secondary energy source 50 to selectively control initiating the device 10. The detonator connector 56 couples to the appropriate electronic components of the detonator device 10, e.g., via the connecting cable 58, as illustrated.

Still further, the NEBD 10A may include RFID technology, position determining technology such as GPS, communications capabilities, a timer or other timing system and other miscellaneous control electronics.

In the illustrated example, the controller 52 implements functions similar to the controller 18 of FIG. 2. Similarly, the primary energy source 48 can be implemented in a manner analogous to the primary energy source 22A of FIG. 2, and the secondary energy source 50 can be implemented in a manner analogous to the secondary energy source 22B of FIG. 2. Still further, the low voltage to high voltage converter 54 can be implemented in a manner analogous to the converter 20 of FIG. 2.

Alternate Exemplary Two-Component Detonator in a Conventional Form Factor

Figure 4B:
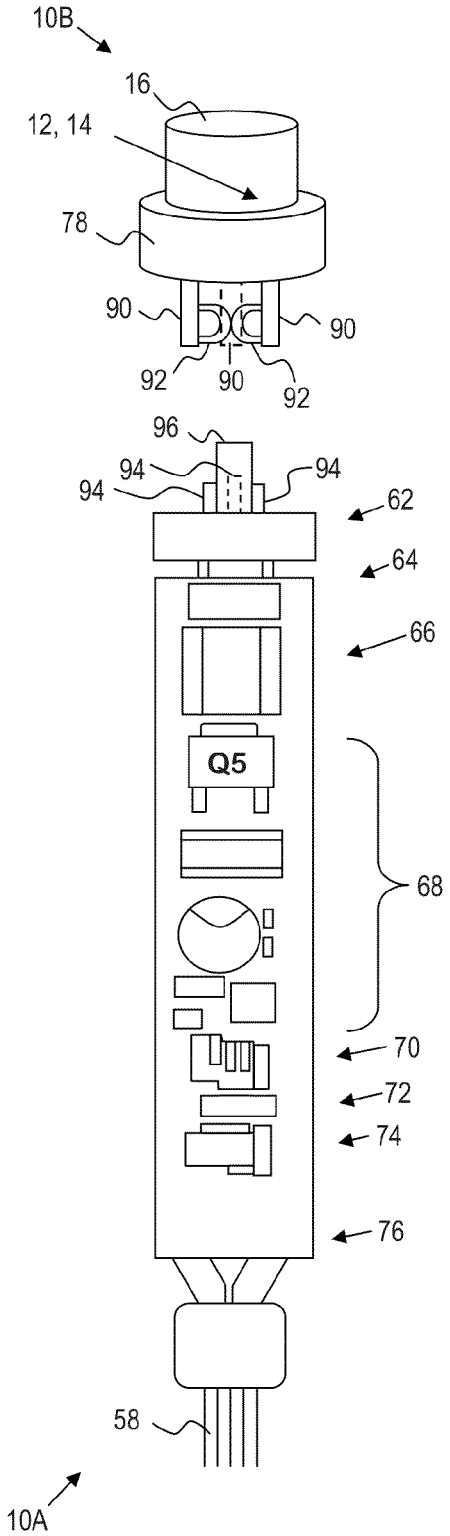
FIG. 4B is a schematic illustration of an alternative two-component detonator system according to further aspects of the present invention.

Referring to FIG. 4B, a detonator device 10 according to further aspects of the present invention is illustrated where the switch 12, initiator 14 and initiating pellet 16 are provided as part of the initiating component 10B. In the illustrative embodiment, the NEBD 10A includes electronics, including a HPCU as described in greater detail herein, e.g., with reference to FIGS. 1-4A, or combinations thereof. Alternatively, the example set out below with reference to FIG. 4B can be applied analogously to the previously described implementations of the device 10.

In an exemplary, illustrative implementation, the NEBD 10A comprises an interface 62, a high voltage switch component 64, firing capacitors 66, a low voltage to high voltage converter 68, a controller 70, bleed down resistors 72, switch driving electronics 74 and a bus interface 76. The NEBD 10A also comprises an optional detonator connector 56 (not shown) and a connecting cable 58, in a manner analogous to that set out in FIG. 4A.

The interface 62 is functionally analogous to the header 42, header socket 44 and connections 46 in FIG. 4A, but is structurally different to accommodate the configuration of the initiating subsystem 10B. In a manner analogous to that described more fully herein, the high voltage switch component 64 couples a high voltage to the interface 62 from the corresponding high voltage circuitry. The high voltage switch 64 may, in practice, be implemented as a high voltage FET device, or a plurality of FET devices, e.g., coupled in series. The high voltage switch component 64 allows separate, independent circuitry for functioning the initiator 14 by separately controlling when the secondary energy source closes the switch 12 as described more fully herein. In an alternative implementation, the high voltage switch component 64 holds off high voltages from at least one of the primary energy source and secondary energy source, e.g., charged firing capacitor(s), until commanded by the controller 70, e.g., a corresponding microcontroller of the non-energetics based subsystem, to fire. The high voltage switch component 64 may also be included in the arrangement of FIG. 4A.

In an illustrative arrangement, the high voltage switch component 64 functions as a switch to control the high voltage switch 12 of the initiating subsystem 10B. Thus, for example, the switch component 64 may be utilized to operate the control element 12D of the high voltage switch 12 in a manner analogous to the switch 29 described with reference to FIG. 2. As noted in greater detail herein, the high voltage switch 12 is arranged to provide additional protection of the primary firing circuit from unintentional exposure to firing sources and to isolate the primary firing circuit from a completed conductive path.

In order to generate the high voltage required to function the initiator 14, energy is temporarily stored in the firing capacitor(s) 66. The firing capacitor(s) 66 are implemented in a manner analogous to the primary energy source 22A, 48 and secondary energy source 22B, 50 described more fully herein. In an illustrative example, the primary energy source is implemented by a high voltage pulse capacitor that can store the appropriate energy and voltage, e.g., up to 1.5 kV to 2.0 kV, and provides the very high power pulse (megawatts) necessary to fire an EFI-based initiator 14. In an analogous manner, the secondary energy source is also implemented in the corresponding firing capacitor(s) 66. The implementation described herein is thus immune to exposure to almost all unintentional sources such as RF, static electricity, stray currents, etc., and allows elimination of primary explosives from the detonator. Comparatively, conventional detonators operate on low voltages, require sensitive primary explosives, and can be susceptible to exposure from stray sources.

The low voltage to high voltage converter 68 is utilized to generate the high voltage requirements to charge the firing capacitors 66. For instance, the low voltage to high voltage converter 68 for the various implementations described herein, comprises conversion circuitry such as a flyback transformer or other multiplication technologies that facilitate fast charging up to the desired operational voltage, e.g., in excess of 800 volts and optionally up to 2.0 kV or more in order to fire an EFI-based initiator 14 from an input voltage of 12 volts to 15 volts.

The controller 70 is analogous to the controller 18 of FIG. 2 and/or the controller 52 of FIG. 4A. In an illustrative example, the controller 70 comprises a microcontroller that is preprogrammed with algorithms for command operation of the detonator, such as receiving of input detonation time, receipt and execution of detonator charging command, receipt and execution of detonator abort command, detonator charge status, receipt and execution of firing command, etc. The controller 70 also controls detonator functions such as detonator charging via the flyback transformer of the low voltage to high voltage converter 68, charging and triggering of HV switch electronics 64, etc.

Bleed down resistors 72 are provided in the illustrative implementation as a fail-safe measure to drain energy from the firing capacitors 66 should an abort be necessary, if control/charging power is lost, should a loss of continuity occur during the shot firing sequence, etc. For instance, the bleed down resistors 72 are configured to drain electrical energy from firing capacitors 66 in less than a predetermined time, e.g., less than one second. Thus, for instance, the system will default to a safe state automatically upon the cessation of input charging voltage from a corresponding blasting (computer) controller system. The bleed down resistors 72 may also serve to protect circuitry from unintentional electrical stimuli.

Switch driving electronics 74 are utilized to trigger the high voltage switch 12, e.g., via triggering the high voltage switch component 64. The switch 12 holds off the high voltage of the primary firing capacitor/EFI circuit until the high voltage switch 12 is suitably closed as described in greater detail herein.

The bus interface 76 is utilized for transferring data to and from the components of the NEBD 10A. The bus interface 76 may also be utilized to supply power, e.g., in the range of 12 V to 15 V, from an external source via the wiring 58 for operation, to transfer commands from an associated blasting computer to the controller 70, and to transfer data back from the controller 70 to a corresponding blasting computer.

Plug-In Connection of the Initiating Subsystem into the NEBD

The initiating subsystem 10B in the illustrated example comprises the initiating pellet 16 over a mounting body 78 that supports the high voltage switch 12 and the initiator 14. According to aspects of the present invention, the mounting body 78 serves as an EFI/Barrel/Pellet mounting and alignment fixture designed to accurately position the EFI chip for optimum firing of the (insensitive explosive) initiating pellet 16 and includes a first holder that secures the initiating pellet and a second holder that secures the initiator and switch and mates with the first holder.

Figure 4C:
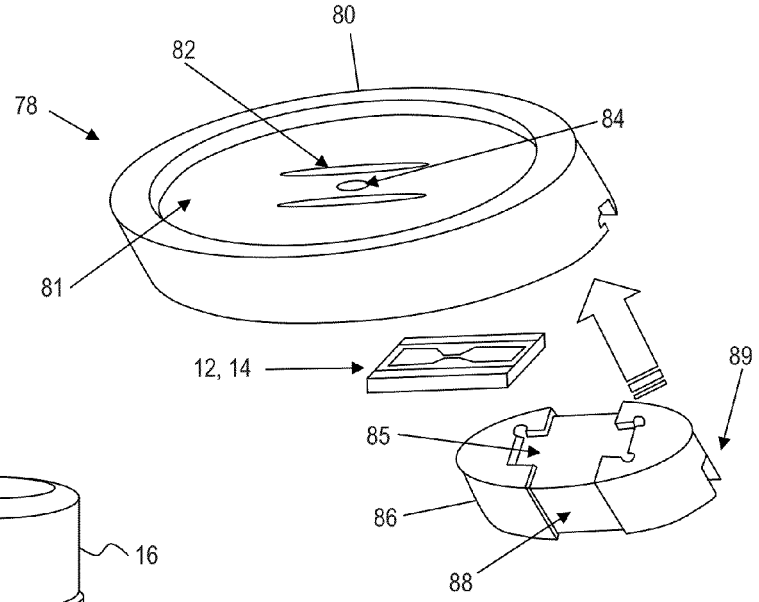
FIG. 4C is a schematic illustration of a mounting body utilized to support an initiating subsystem for use with a two-component detonator system, according to various aspects of the present invention.

Referring briefly to FIG. 4C, the mounting body 78 comprises a first holder defined by a top disk 80 having a pellet cup 81 that receives the initiating pellet 16 and helps to register the initiating pellet 16 with the corresponding initiator 14. The pellet cup 81 includes solder clearance slots 82 and a barrel feature 84 for aligning the EFI-based initiator 14 with the initiating pellet 16.

The fixture defined by the mounting body 78 also provides a mounting surface for the electrical connections that interface with the NEBD 10A via the second holder. For instance, the chip substrate containing the switch 12 and the initiator 14 is precisely positioned, seated and/or otherwise embedded into a chip nest 85 of a bottom section 86 of the second holder, which also aids in assembly and alignment of the initiator 14 and the barrel to the initiating pellet 16. The bottom section 86 also includes clearance insets 88 such as through slots around its perimeter that allow clearance for leads necessary to form the electrical circuit path from the interface 62 of the corresponding NEBD 10A to the switch 12 and initiator 14 nested within the chip nest 85 of the second holder. The backside 89 of the bottom section 86 features a slot for firm embedment of the inserted NEBD 10A into this fixture. Moreover, the bottom section 86 also inserts into the pellet cup 80.

In various embodiments of the present invention, the barrel assembly 84 is directly integrated into to the EFI chip, i.e., replaces the barrel 38 illustrated with regard to FIGS. 2 and 3. Alternatively, the barrel assembly 84 may be integrated into the top disk 80, e.g., to cooperate with or replace the barrel 38. Regardless, the integrated barrel assembly 84 aligns over the bridge of the EFI-based initiator 14. The pellet cup 81 also includes cup feature for accurate mounting of the initiating pellet 16. This disk is designed to allow the surface of the bridge section of the EFI chip to come to rest on the underside of the barrel interface. The barrel thickness is accurately controlled through CNC machining or other suitable methods for optimum performance. As such, the barrel assembly 84, according to various aspects of the present invention, provides proper standoff and alignment between the explosive pellet 16 and bridge of the EFI initiator 14, allows a suitable travel path for the EFI launched flyer to impact the explosive of the pellet 16, and provides a complimentary planar mounting surface for the EFI initiator 14 and the explosive pellet 16.

The combination of the initiator 14 and the initiating pellet 16 may be useful, for example, where it is difficult to align the initiator 14 with the initiating pellet 16 in the field. In this situation, the alignment of the initiator 14 and the initiating pellet 16 is controlled, e.g., during manufacturing.

According to various aspects of the present invention, the switch 12 and initiator 14 are micro-fabricated onto the same substrate such that the switch is capable of holding off well in excess of the nominal 1,500 volt charge necessary to fire the initiator, implemented as an EFI. The extremely small size and joint fabrication steps of the switch 12 with the initiator 14 give it a significant advantage in size, cost, and capability compared to standard electronic parts.

Slots 82 allow clearance of the solder joints between the EFI chip and its extended electrical connections. Above this layer, the pellet cup 81 allows accurate mounting of the initiating pellet 16. The underside of this feature includes inboard slots that align with the slots in the nest disk 85 or some other suitable positive mechanical engagement feature for positive lock-in of the NEBD 10A.

Referring back to FIG. 4B, fireset interface legs 90 extend from the mounting body 78 opposite the initiating pellet 16, and form a circuit with the corresponding switch 12 and/or initiator 14. The interface legs 90 optionally include self shunting features 92, e.g., protruding electrical connections. The self shunting features form an electrical connection with each other when the initiating subsystem 10B is disconnected from a corresponding NEBD 10A to shunt stray interference.

In an illustrative implementation, a first pair of interface legs 90 extend from the mounting body 78 and form a series circuit with the high voltage switch 12 and initiator 14 (primary circuit). Correspondingly, the interface 62 of the NEBD 10A includes a first pair of electrically conductive contacts 94 spaced apart by an insulating layer 96. Each of the conductive contacts 94 of the first pair is electrically coupled to a circuit path associated with the primary energy source, e.g., as implemented by the firing capacitors 66.

When the NEBD 10A is suitably mated with the initiating subsystem 10B, a first pair of interface legs 90 are separated apart by the insulating layer 96 and each leg 90 is spring biased against a corresponding one of the conductive contacts 94. In this regard, the insulating layer 96 serves to guide the initiating subsystem 10B to mate with the NEBD 10A. As such, the spring loaded conductors defining the self shunting features 92 of the first pair of interface legs 90 provide both a self shunting function and an electrical connection that couples the series circuit of the high voltage switch 12 and initiator circuit 14 to an inserted NEBD 10A.

Optionally, a second pair of interface legs 90 extends from the mounting body 78 and form a circuit with the trigger element 12D of the high voltage switch 12. The second pair of interface legs 90 each contact a second pair of electrical conductive contacts 94 of the interface 62 when the NEBD 10A and initiating subsystem 10B are mated. The second pair of conductive contacts 94 further couple to control electronics including the secondary energy source. In this regard, each contact pad 94 is spaced from one another by the insulating layer 96. The legs 90 may alternatively comprise, for example, pins, sockets, plates, etc. In this manner, the conductive contacts 94 may be replaced by corresponding mating counterpart structures.

Figure 4D:
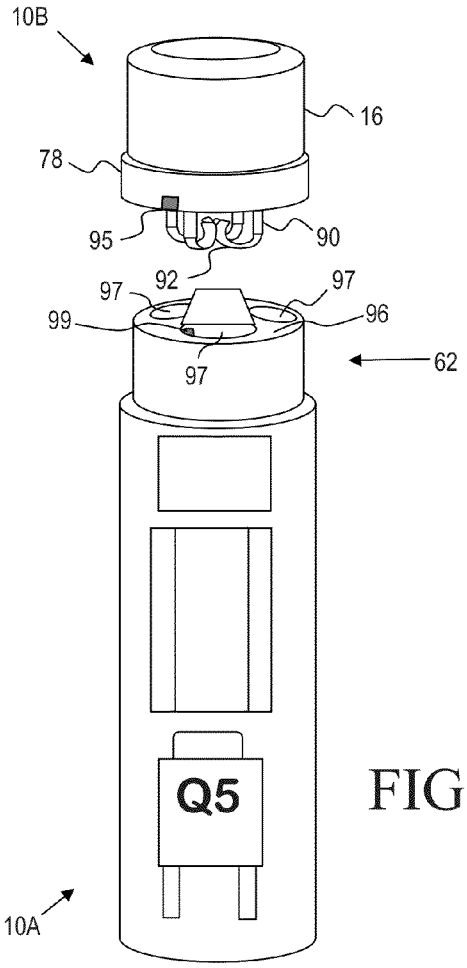
FIG. 4D is a schematic illustration of yet a further alternative two-component detonator system according to further aspects of the present invention.

Referring to FIG. 4D, according to further aspects of the present invention, an alternative arrangement of the interface legs 90 is illustrated. In the illustrative figure, the NEBD 10A is identical to the NEBD 10A except for the physical geometry of the header 62. For instance, as illustrated, the initiating subsystem 10B includes four interface legs 90, a first pair associated with the series circuit of the high voltage switch 12 and corresponding initiator 14 and the second pair is associated with the trigger element of the high voltage switch 12, as described more fully herein. All four legs include a self shunting feature 92 that shorts the legs together when the initiating subsystem 10B is not mated with a corresponding NEBD 10A. The mounting body 78 includes a notch 95 that is utilized for aligning the initiating subsystem 10B with the corresponding NEBD 10A. However, other aligning features may alternatively be used.

The electrical/mechanical interface 62 of the NEBD 10A in the illustrative example, is implemented as a female socket having four socket receptacles 97, one socket receptacle for each corresponding leg 90. The interface 62 also has a key 99 for aligning the initiating subsystem 10B to the corresponding NEBD 10A. The four socket receptacles 97 are separated by an insulating separator 96 to define four unique compartments. Thus, during use, the initiating subsystem 10B is aligned with the NEBD 10A by the key 99 and corresponding notch 95. As the legs 90 of the initiating subsystem 10 are guided and plugged into the interface 62 of the NEBD 10A, the shunting feature 92 of the legs 90 separate due to the insulating layer 96. When the legs 90 are fully inserted into the corresponding socket receptacle 97, the conductive legs 90 make electrical contact with corresponding contacts within the interface 62 such that a first pair of legs 90 form a first circuit with the switch 12 and initiator 14 (primary circuit), and a second pair of legs 90 form a circuit with the trigger element of the switch 12 (secondary circuit).

Low Inductance Path

With reference to FIGS. 4A-4D generally, the primary and secondary circuits have extremely low inductance, e.g., less than 50 nanohenries. This low inductance helps facilitate the ability of the detonator according to various aspects of the present invention, to develop megawatts of power necessary to function the EFI-based initiator from a primary energy source such as a charge capacitor 48 that has a small size dimensioned to fit, for example, in a detonator housing of conventional size and form factor.

By way of illustration, the primary energy source may be charged to an armed state of at least 800 V to 1,500 V by the low voltage to high voltage converter. Comparably, the secondary energy source may be charged to a voltage of around 100 V or greater, e.g., between 100 V and 500 V. The timing of when the primary and secondary capacitors are charged and the overall operation of the NEBD 10A is controlled by the controller contained within the NEBD 10A. In this regard, detonation sequencing will be described in greater detail below.

According to aspects of the present invention, low voltage power is provided to the NEBD 10A via the detonator connector 56 and corresponding connecting cable 58. The low voltage is selectively applied to the on-board firing set (electronics) for conversion to the high voltage and power necessary to function the initiator 14 under command of the controller 52 as described more fully herein. Comparatively, conventional detonators receive their high voltage pulse from an external firing set, and not from high voltage generating circuitry built into the detonator, as implemented according to various aspects of the present invention. The conventional approach to using external firing sets limits the firing line distance because of the line inductance inherent in locating the firing set away from the detonator. For example, high line inductance limits the fast, high current pulses needed to "explode" the bridge wire that functions the conventional EBW or vaporize the narrowed channel on an EFI. The external firing set in the conventional approach further limits the number of detonators than can be fired on a single circuit.

However, the detonator device 10 according to aspects of the present invention includes built-in low voltage to high voltage conversion electronics, a high voltage switch 12 and an EFI-based initiator 14 while maintaining a packaging that appears as if it were a conventional detonator configuration, e.g., has the general size and shape of a typical detonator housing. As such, a blast operation can easily handle a multitude of detonators 10A in its "network," e.g., by plugging multiple detonator devices 10 into a busline. In this regard, there are no practical firing line length limits when using the detonator devices 10, as described in greater detail herein, because a high voltage is not being pumped through a corresponding network of interconnections. That is, the busline is not carrying a high voltage necessary to function the switch 12 and/or initiator 14 of each detonator. As such, inherent losses in the network, e.g., due to cable resistance, inductance and/or capacitance, which can cause liabilities such as voltage drop or otherwise limit the fast, high current pulses necessary function the detonator(s) are mitigated.

Integration with a Booster

According to further aspects of the present invention, the initiating subsystem 10B of the detonator device 10 may be integrated with, e.g., fixedly installed in or permanently embedded inside, an explosive product such as a booster without increasing the hazard class and the associated transportation, handling, and storage restrictions regarding that product. In commercial blasting applications, detonators commonly interface with cast boosters to detonate, in turn, other blasting agents (typically ANFO, water gels, emulsions, or heavy ANFOs). These boosters are most commonly comprised of pentolite (50% TNT, 50% PETN) or Comp B (60% RDX, 40% TNT). Since the insensitive explosive used in the initiating pellet 16 (typically HNS-IV) is less sensitive than the explosive used for the booster (typically pentolite or Composition B), fixing or otherwise permanently embedding the initiating pellet 16 inside of the booster, before mating the initiating subsystem 10B with a corresponding NEBD 10A, e.g., at the time of manufacture of the booster, will not affect the sensitivity or any of the handling procedures for the booster.

Figure 5:
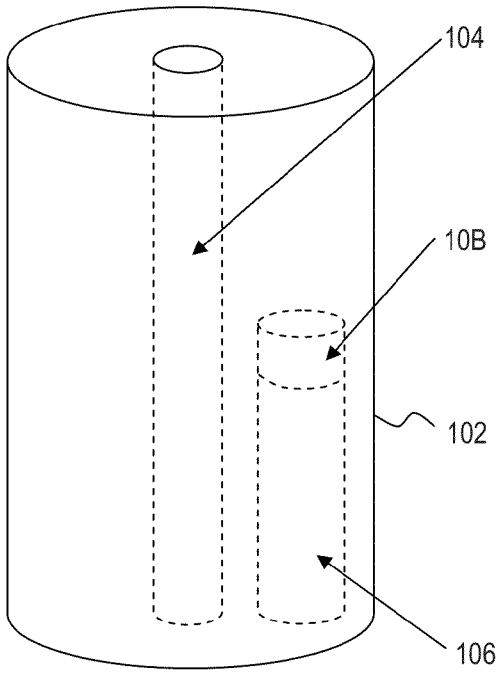
FIG. 5 is a schematic illustration of a cast booster that integrates with a two-component detonator system according to various aspects of the present invention.
Figure 6:
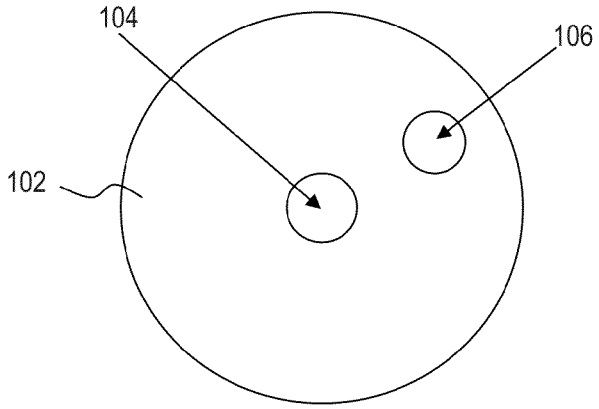
FIG. 6 is a top view of the cast booster of FIG. 5.

Referring to FIGS. 5 and 6, a cast booster 102 is provided in a booster shell that includes a through tunnel 104 that extends entirely through the booster body. As illustrated, the cast booster 102 is generally cylindrical in shape, and the through tunnel 104 is generally coaxial with the cast booster 102. The cast booster 102 also includes a detonator well 106. The detonator well 106 has an opening at a surface of the cast booster 102 and extends within the cast booster 102. However, as illustrated, the detonation well 106 does not extend entirely through the cast booster 102. According to certain aspects of the present invention, the initiating subsystem 10B is installed within the detonation well 106.

According to certain embodiments of the present invention, the incorporation of an initiating subsystem 10B into a booster 42 allows the manufacture of a non-energetics NEBD 10A that could normally only be used with the booster 42 (having an integrated initiating subsystem 10B). Since the initiator 14 is tailored to specifically initiate the pellet 16 and in turn the booster 42, the NEBD 10A would not initiate standard boosters that do not contain the pellet 16.

According to alternative embodiments of the present invention, e.g., using a detonator arrangement analogous to that set out with reference to FIG. 4B, the initiating subsystem 10B, e.g., including a switch 12, initiator 14 (with shunting legs) and pellet 16, are seated into the top of the detonator well 106, e.g., at the time of manufacture of the booster. Thus, boosters further incorporate the initiating subsystem 10B, which include an initiating pellet 16 of insensitive explosive like HNS-IV at the top end of the detonator well 106, which allows interfacing of this insensitive initiating explosive with the non-explosive based NEBD 10A as described more fully herein. Moreover, the detonator device 10 may be specifically tuned to directly initiate a corresponding booster, even where the booster material is pentolite or Comp B. Since the initiating pellet 16 is much less sensitive and has a much higher temperature tolerance than the booster material, the incorporation of this small pellet 16 will not change the hazard class of the associated booster and accordingly, will not require an alteration to the manner in which such boosters are transported, stored, and used. As another illustrative example, the pellet 16 may comprise PETN. In this application, the PETN could be used in combination with HNS-IV, or alternatively, the initiator 14 may be "tuned" to initiate PETN directly without the need for the HNS-IV.

Comparably, commercial detonators used for the mining, quarrying, and construction industries use a very sensitive primary explosive (typically lead azide) to transition the output detonation from an initiating mechanism to a secondary output pellet (typically PETN). As such, an attempt at the integration of a conventional initiator into a booster or other such explosive product is not practical because the primary explosive from the conventional commercial detonator is much more sensitive than the booster explosive, thus making the booster more sensitive to inadvertent initiation by exposure to heat, impact, friction, etc. Such attempted integration would further increase the hazard classification of the booster and increase the hazards associated with handling, transporting, storing the booster.

The Non-Energetics Detonator/Booster

Figure 7:
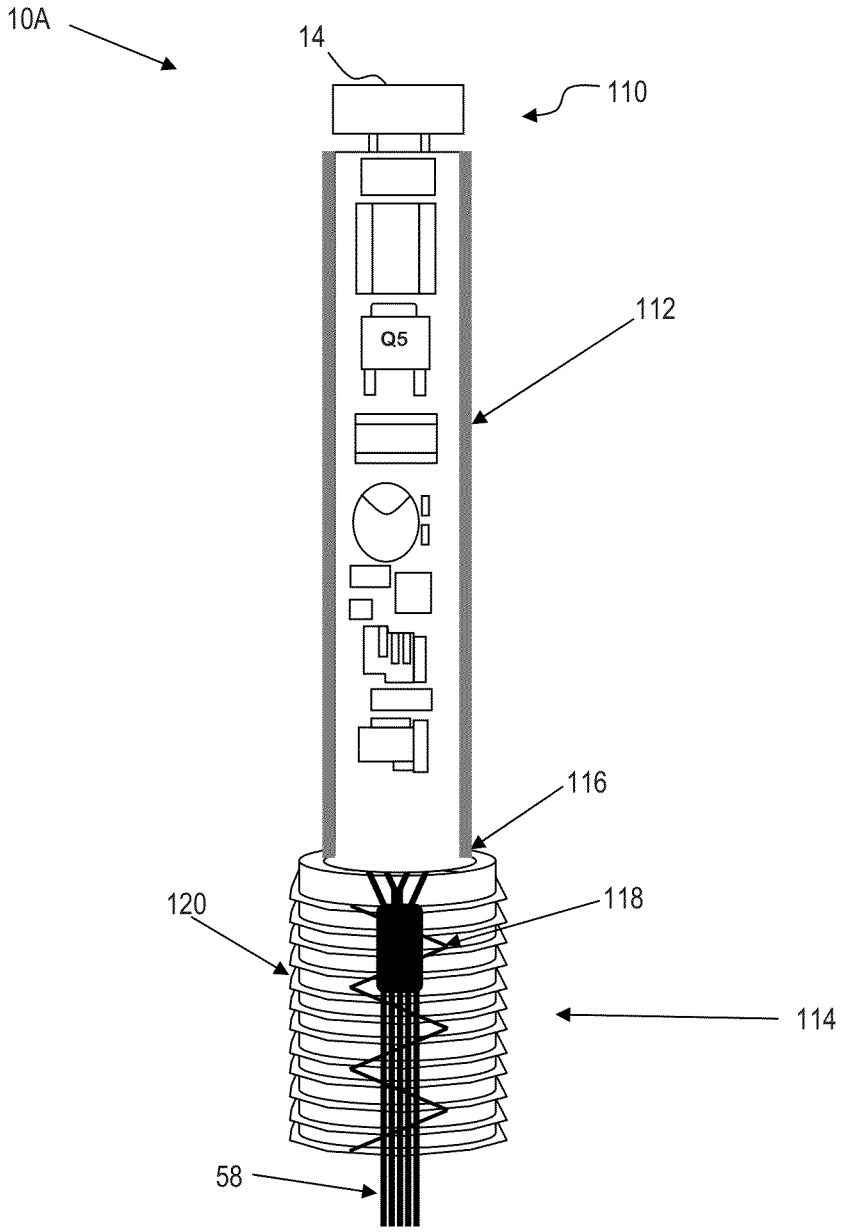
FIG. 7 is a schematic illustration of a non-energetics based detonator component of a two-component detonator system, for interfacing with a booster according to various aspects of the present invention.

As noted above, the initiator 14 may be including as part of the NEBD 10A as an alternative to its inclusion with the initiating subsystem 10B. Referring to FIG. 7, a NEBD 10A according to various aspects of the present invention, includes a header 110 at a top engaging surface thereof. The header 110 is analogous to the header 42 of FIG. 4A, and includes the initiator 14 positioned so as to be able to deliver a suitable signal to the corresponding pellet 16, which is installed in a corresponding cast booster 102 as part of the corresponding initiating subsystem 10B embedded into the booster 102. Moreover, the NEBD 10A may include a potting 112 to seal and protect the internal components, which may include any of the various configurations or variants thereof, as described in any of the embodiments herein. In general, the NEBD 10A of FIG. 7 is analogous to those set out in the previous figures. However, the detonator device of FIG. 7 differs from the previous detonator devices in that the NEBD 10A of FIG. 7 further includes a booster interface 114 about its end opposite the header 110. The booster interface 114 includes an o-ring seal 116, a spring 118 for detonator take up and a booster interfacing plug 120 for interfacing with a corresponding booster 102.

Figure 8A:
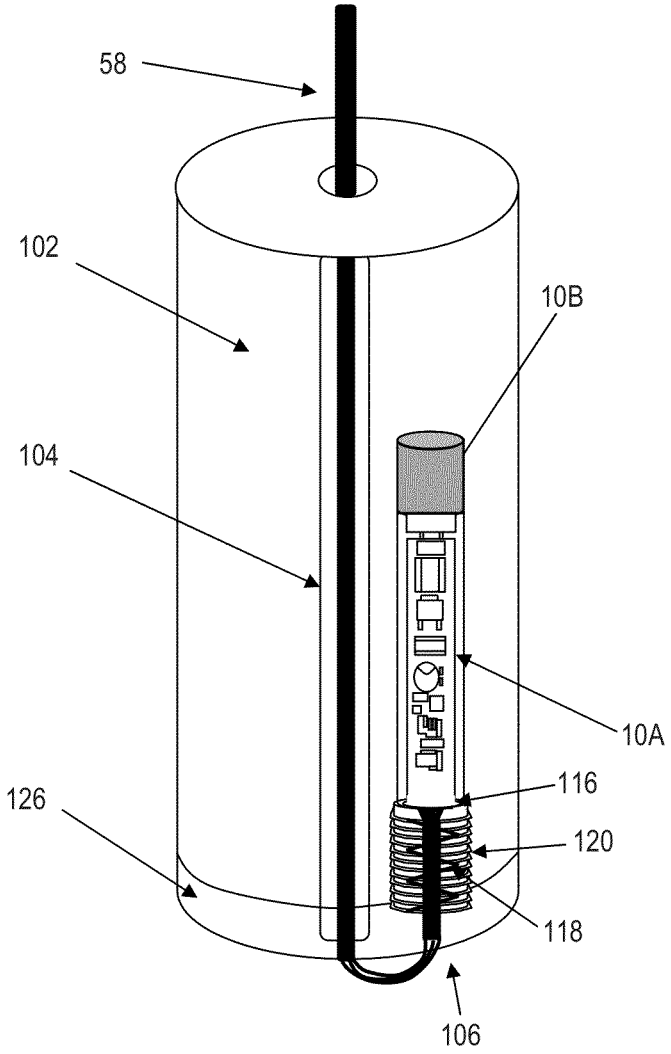
FIG. 8A is a schematic illustration of a two-component detonator system interfaced with a booster according to various aspects of the present invention.

Referring to FIG. 8A, an "x-ray" view of a booster is provided to illustrate the detonator system 10 installed therein. The detonator wires 58 pass through the through tunnel 104 of the cast booster 102 and are coupled to the NEBD 10A. The cast booster 102 includes a corresponding initiating subsystem 10B embedded in the detonation well 106. Depending upon the cast booster 102, an optional booster interfacing base 126 may be provided to interface the booster interface 114 of the NEBD 10A. The NEBD 10A is inserted into the detonator well 106, e.g., by threading or otherwise feeding the detonator booster interfacing plug 120 into a corresponding receiving member of the booster interfacing base 126. As the NEBD 10A is inserted, the spring 118 provides a takeup feature to ensure that the NEBD 10A, and in particular, the initiator 14, is properly in register with the initiating subsystem 10B already in the detonation well 106.

For instance, where the initiator 14 is implemented as an EFI, the takeup mechanism of the spring 118 ensures that an integrated EFI barrel 38, which may be exposed as the NEBD 10A is inserted into the detonator well 106, is engaged with the initiating pellet 16 of the initiating subsystem 10B at the top of the booster's detonator well 106. When inserted into the booster 102, the plug 120 locks the NEBD 10A into the base 126 of the booster 102. The o-ring seal 116 provides a sealing feature about the interface of the NEBD 10A with the booster 102. However, other sealing provisions may also/alternatively be implemented so that when the plug 120 is inserted into the booster's base 126, the engaged seal prevents any water from a wet blasthole from intruding into the detonator well 106.

The threaded plug 120 for inserting the NEBD 10A into the booster is presented by way of illustration, and not by way of limitation. The NEBD 10A may also be inserted into a booster using some derivation of a "clip-in" type connector with a take up mechanism, examples of which are described with reference to FIG. 18A through FIG. 19C. Regardless of the configuration, the NEBD 10A may further incorporate a sealing provision to prevent the intrusion of water into the well.

Figure 8B:
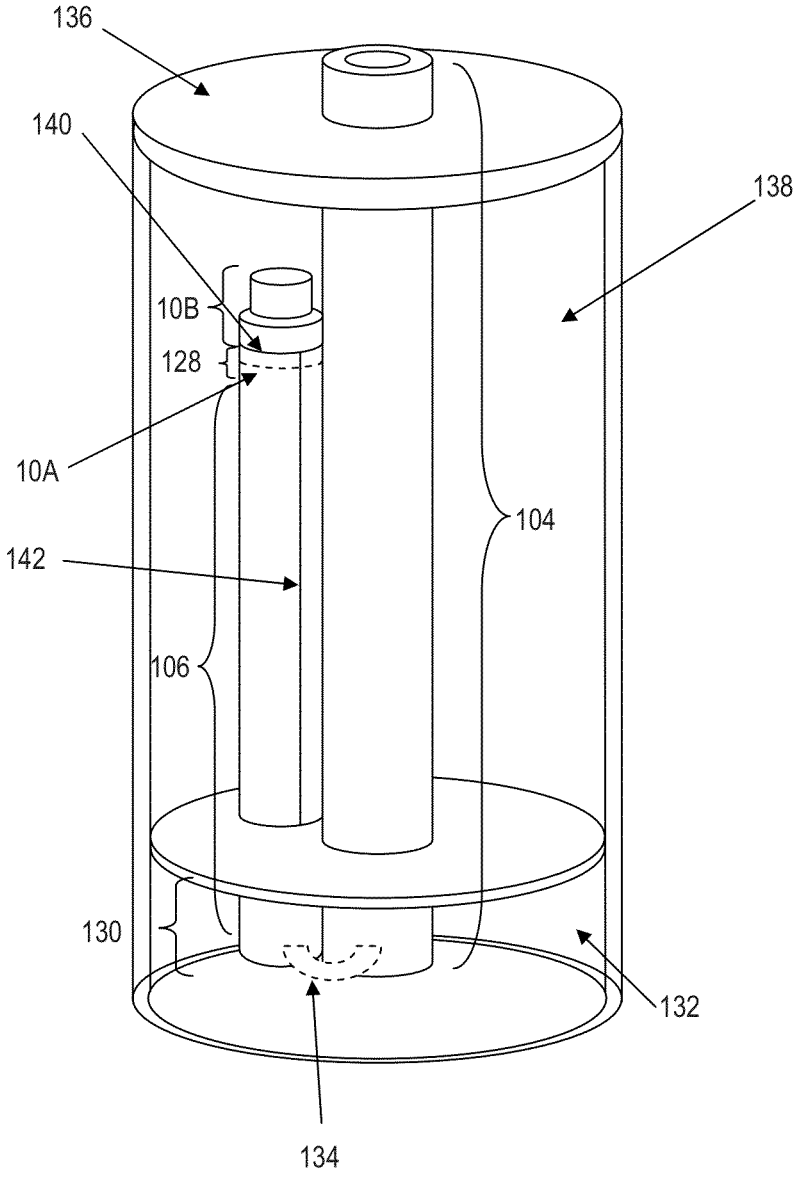
FIG. 8B is a schematic illustration of an alternative two-component detonator system interfaced with a booster according to further aspects of the present invention.

Referring to FIG. 8B, a cast booster assembly is again illustrated in "x-ray" view to illustrate certain internal components. This illustrated cast booster 102 is interfaced with the detonation system 10 of FIG. 4B, 4C. The illustrated booster assembly includes a housing that is designed to include the initiating subsystem 10B and allows for simple field insertion of the NEBD 10A. The housing of the booster 102 protects all of the in-hole system components and is meant to appear and function like a conventional cast booster. The booster 102 contains normal melt/pour explosive material typically used in this application, such as pentolite or Composition B.

The initiating subsystem 10B can be attached to the top of the detonator well 106 before melted explosive is loaded into booster container as temperature ratings of explosives in the initiating pellet 16 are much higher than that realized for melt/pour explosives. Also, explosive(s) in the initiating pellet 16 are also much less sensitive than those used in the booster 102. Correspondingly, the initiating subsystem 10B may be installed after the explosives are loaded into the cast booster 102.

At 128, the electrical leads of the initiating subsystem 10B, e.g., the interface legs 90 are mated with corresponding conductive contacts 94 of the interface 62 of the NEBD 10A to complete the primary circuit and/or secondary circuit. This arrangement allows simple plug in and done operation of the NEBD 10A. As noted in greater detail herein, should the NEBD 10A be removed from the detonator well 106, the shorting features 92 short the legs 90 and shunt electrical interference from functioning the initiator 14. The base end of the detonator well 106 may include a groove a short distance inside its end for engagement of detents in the NEBD 10A. In this regard, engagement removal subsystems will be described in greater detail herein.

In an illustrative example, the detonator well 106 includes a seat 140 recessed back into the detonator well 106, e.g., at its top for inclusion of the initiating subsystem 10B. Moreover, the detonator well 106 provides for the insertion of the NEBD 10A into the booster assembly and properly aligns the NEBD 10A with the embedded initiating subsystem 10B. Thus, an alignment feature is provided, which guides the non-energetics subsystem 10A into the detonator well 106 so as to align and properly mate the inserted non-energetics subsystem 10A with the initiating subsystem 10B installed into the detonator well 106. For instance, a positioning groove 142 (or other alignment options) and/or the internal diameter of the detonator well 106 may be utilized to align the NEBD 10A with the electrical legs 90 of the initiating subsystem 10B. The detonation well 106 protects the detonator device 10 from the downhole environment when the corresponding booster 102 is loaded into a blasthole.

In an illustrative implementation of the present invention, a detonator plug-in 130 of the booster's detonator well 106 features a groove for a click in and removable NEBD 10A securing mechanism. The use of a groove or other suitable arrangement permits use of a securing mechanism and positive engagement of the inserted NEBD 10A with the embedded initiating subsystem 10B.

The detonator through tunnel 104, e.g., along a center axis of the booster 102, allows feeding of wiring for the NEBD 10A through the tunnel 104 and back up into the detonator well 104. This arrangement further facilitates common cap up positioning of the booster inside the blasthole. In an illustrative example, the through tunnel 104 allows the NEBD 10A to pass through it and back up into the detonator well 106. In this orientation the NEBD 10A is facing back up the hole and the booster 102 is suspended through its center axis.

A base section 132 of the booster 102 accommodates routing, securing, and protecting the NEBD 10A and its wiring inside the booster 102. The base section 132 is designed to isolate the detonator well and through tunnel access from the cast explosive. Still further, the base section 132 allows click in securing of a puck shaped enhanced detonator as will be described in greater detail herein. An extended edge of the base provides a standoff from the in-hole resting position of the booster for clearance of the wiring for the NEBD 10A. Additionally, an inset saddle 134 connects the through tunnel 104 to the detonator well 106 and provides additional protection of the wiring e.g., from cuts or abrasions resulting from contact with the hole bottom. This protection is also enhanced by the extension of the perimeter case slightly beyond the location of the ends of the detonator well and through tunnel.

A covering cap 136 may be implemented as a snap on cover for the top of the booster housing, e.g., where the booster housing is comprised of plastic booster assemblies. The covering cap 136 covers and protects an otherwise exposed explosive surface and provides access for cast loading explosives 138 into the booster body. For instance, the removal of this cap allows simple pour in loading of explosives into the case. In an illustrative example, a detent ring under an extended rim of the cap 136 snaps into a groove around the top lip of the booster housing for securing the cap 136 to the booster 102.

The features integrated into this booster 102 may alternatively be directly integrated into the cast explosive by means of a specialized mold, e.g., as a measure to eliminate the cost of the plastic case, but retain the advanced attributes. Alternatively the booster 102 could be configured to only be detonated by the insertion of the NEBD 10A. Insertion of a conventional commercial detonator would not detonate the booster in this configuration. This could be accomplished by inclusion of a special casing or casing parts and/or inclusion of insensitive explosives. Alternatively, the booster may be configured to be detonated by insertion of an NEBD or a conventional detonator, thus expanding the range of applications and uses of the booster.

Enhanced Detonator Arrangement

Figure 9:
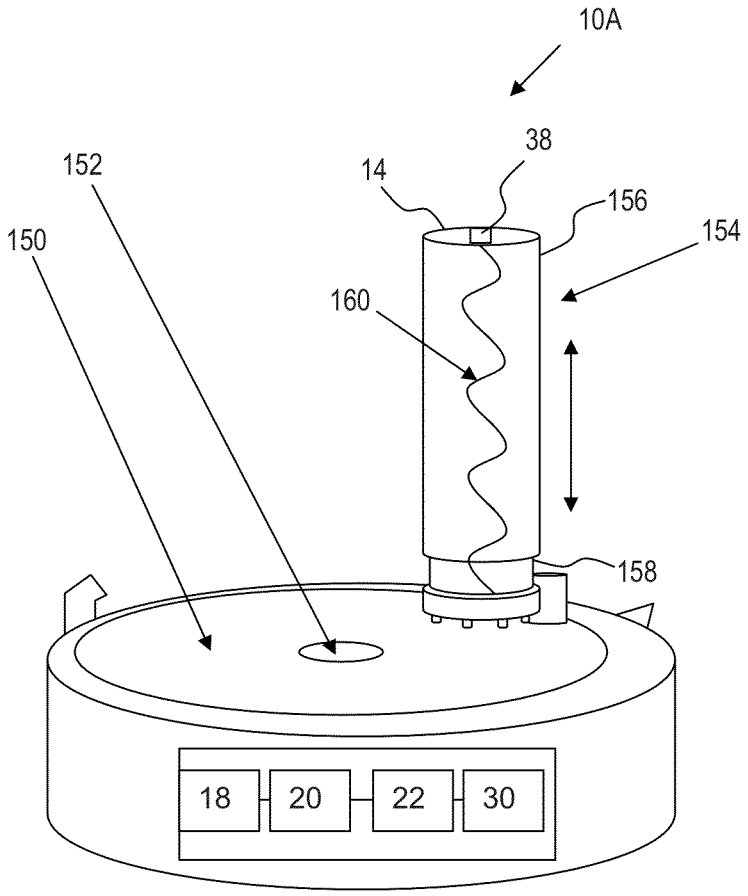
FIG. 9 is a schematic illustration of a two-component detonator system according to further aspects of the present invention.

Referring to FIG. 9, another arrangement of the NEBD 10A is illustrated according to further aspects of the present invention. In this implementation, the electronics and other components of the NEBD 10A are analogous to that described in greater detail with reference to the preceding figures. However, instead of being packaged in a conventional housing, the detonator components are packaged in a puck-shaped housing 150. The puck-shaped housing 150 includes a through passageway 152 that passes through the puck shape. The illustrated through passageway 152 is positioned generally coaxially with puck shape and is positioned and dimensioned to register with a corresponding through tunnel 104 of a cast booster 102 when a cast booster 102 is installed thereon, as will be described in greater detail below. A detonator extension 154 further extends from the puck in a position that corresponds with the detonator well 106 of a corresponding booster 102.

The detonator extension 154 comprises a spring loaded takeup 156 having an initiator 14 at a first end thereof and a spring 158 at the other end thereof.

The initiator 14 is implemented as an EFI with an integrated barrel 38 that defines a bare header for interfacing with an initiating pellet 16 of a corresponding initiating subsystem 10B. Because the initiator 14 is spaced from the electronics within the puck housing 150, a ribbon cable 160 or other suitable interconnect is utilized to couple the initiator 14 to the electronics, e.g., 18, 20, 22A, 22B, 30, etc. as described with reference to FIG. 2; electronics such as header 42, header socket 44, connections 46, primary energy source 48, secondary energy source 50, controller 52, low voltage to high voltage converter 54, etc. as described with reference to FIG. 4A; interface 62, high voltage switch component 64, firing capacitors 66, low voltage to high voltage converter 68, controller 70, bleed down resistors 72, switch driving electronics 74, bus interface 76, etc., as described with reference to FIG. 4B, etc.

Figure 10A:
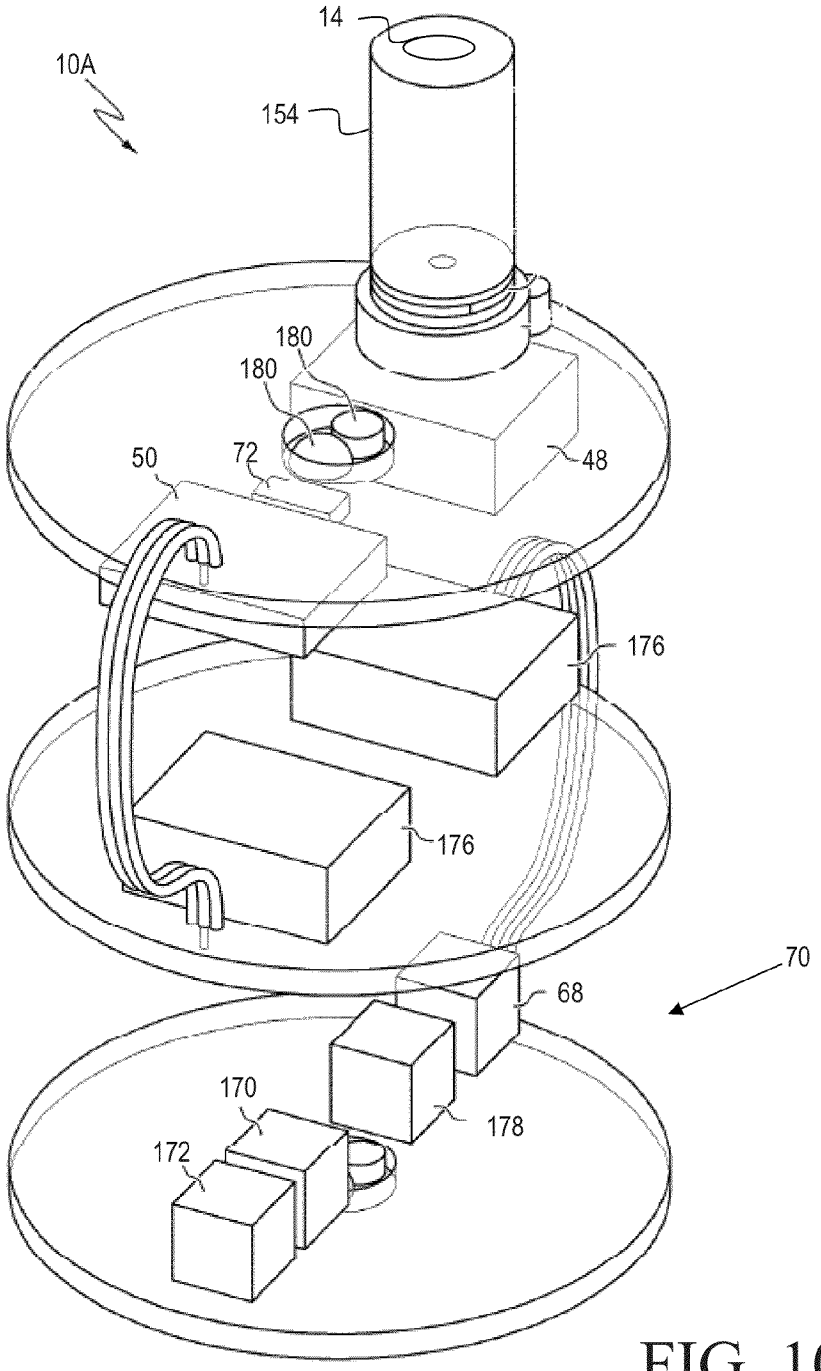
FIG. 10A is a schematic illustration of a puck shaped two-component detonator system according to still further aspects of the present invention.
Figure 10B:
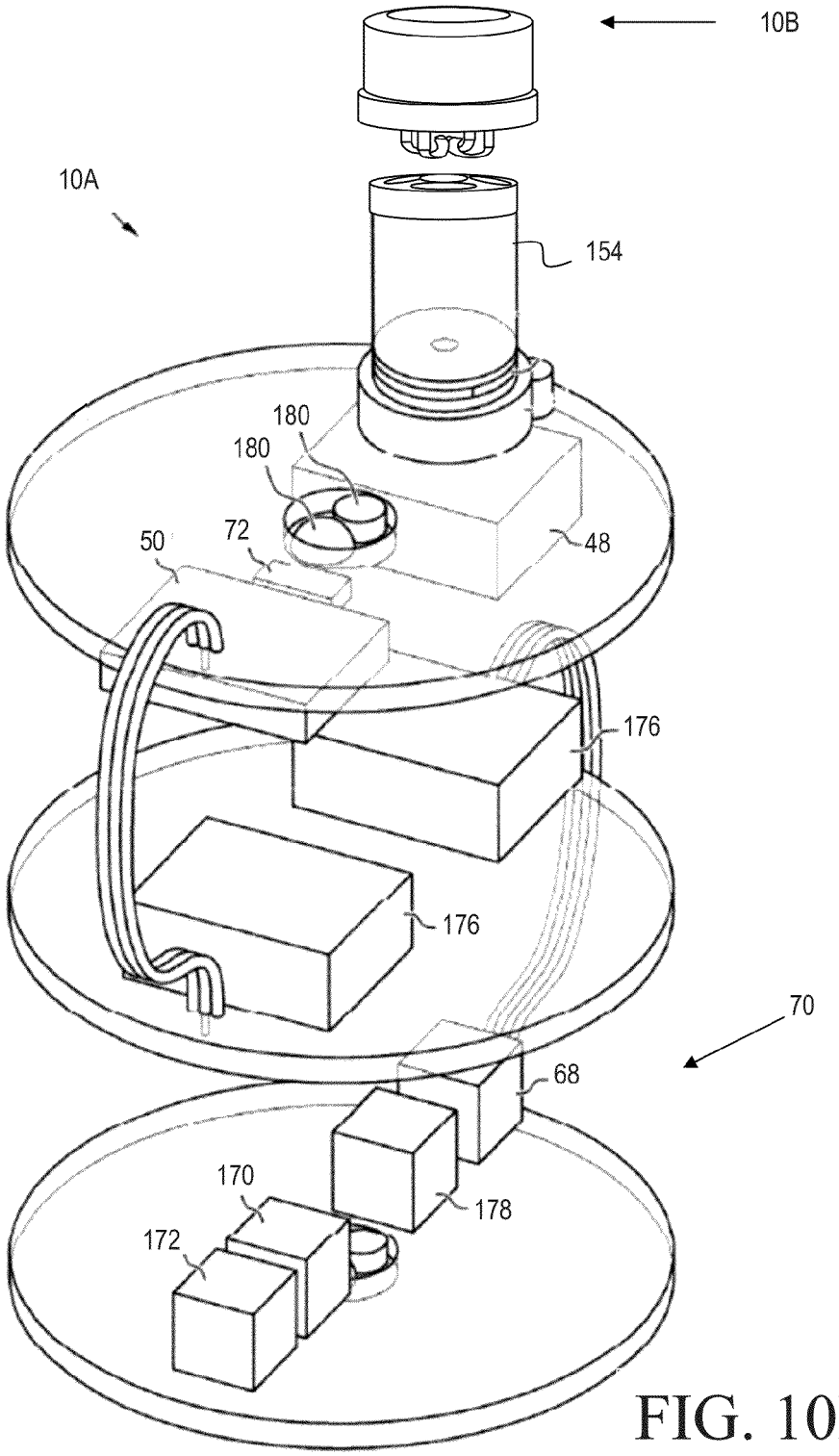
FIG. 10B is a schematic illustration of an alternative puck shaped two-component detonator system according to yet further aspects of the present invention.

Referring to FIGS. 10A and 10B, a NEBD 10A is illustrated according to further aspects of the present invention. The NEBD 10A of FIGS. 10A-10B is suitable for functioning as part of an operationally enhanced system for commercial blasting applications. The NEBD 10A includes components analogous to that described in greater detail herein, in any combination of the preceding figures, where like reference numerals represent like components. Further, any of the components described with respect to any one of the detonator configurations may be implemented in the remainder ones of the detonators described herein. Thus, components described with reference to FIGS. 10A, 10B can also be implemented in the configurations of preceding figures.

For instance, the control electronics include a low voltage to high voltage converter 68, a controller 70, bleed down resistors 72, etc., which may be interconnected using one or more printed circuit boards (PCB). In the illustrative example, the controller 70 is implemented by a programmable timing chip 170, a controller such as a microprocessor 172, self diagnostic components and related circuitry 174 burst communication circuitry 176 and RFID circuitry 178.

In the illustrative implementation, the detonator housing is generally puck shaped. An inductive core includes one or more through tunnels 180 (two through tunnels 180 as illustrated) built into the center of the detonator puck, e.g., within the through passageway 152, for inductive linking and communication. At least one of the through tunnels 180 optionally includes an inductor proximate to the through tunnel 180, e.g., a toroidal inductor having a through hole generally coaxial with the corresponding through tunnel 180, which serves as an inductive pickup for communication with associated circuitry as will be described in greater detail herein. In this regard, inductive linking can utilized by the detonator device 10 as the primary communication and/or powering mechanism. The provision of the through tunnel(s) 180 further eliminates the need for a hardwired connection to the controller 70, and more particularly, the microprocessor 172, of the NEBD 10A.

According to various aspects of the preset invention, the NEBD 10A is connected to a suitable network by passing two separate downline wires through the two through tunnels 180 in the center of the puck, e.g., one wire passing through each through hole 180, and connecting the two ends together electrically after passing them through the puck. Alternatively, a single electrical downline could be threaded through the through hole 180 containing the inductor and held at a hole collar while the detonator device 10 is lowered, e.g. by spooling out the other end of the line. The objective for this method is to end up with both ends of the wire at the hole collar while the detonator device 10 is positioned along the loop, e.g., positioned in the center of the loop at the hole bottom or otherwise positioned along the length of the wire at a desired position within the hole. Regardless of how the wire is passed through the tunnel(s) 180, the system should allow an electrical pulse to pass through the inductor and return back to the generation source outside of the inductor to enable two-way communications between the detonator device 10B and an external source.

The utilization of the through tunnel(s) also allows subsequent detonators 10 required for decking operations to be slid down the downline(s) into their desired positions defining an explosive column. Two-way communications to the detonators 10 are achieved by a sending and receiving a specific series of specialized electrical pulses through the looping connection. The same inductive arrangement may also be used to charge the high voltage capacitor 48 and/or the switch capacitor 50 to facilitate firing the initiator 14. In this regard, according to various aspects of the present invention, multiple detonators 10 can be placed on a single downline and utilize the electric/electronic detonator functionality described more fully herein, in combination with inductive (wireless) communication with a remote controller to carry out coordinated detonation events.

Thus, according to various aspects of the present invention, inductive electronics are utilized for two-way communications to the detonator device 10 and for also powering up a high voltage firing capacitor, e.g., the primary capacitor 48 and/or the high voltage switch capacitor, e.g., the secondary capacitor 50 within the NEBD 10A of the detonator device 10.

According to various aspects of the present invention, another attribute of the detonator device 10, is built-in RFID technology 178, which is configured to provide the ability to automatically resolve each individual detonator's position in a series, freeing the user from the time consuming and mistake prone task of manually identifying each detonator. For instance, the RFID feature provided by the RFID circuitry 178 may be utilized for the automatic identification of the positioning of multiple detonator devices 10 within a single hole, and even on a single wire downline. In this regard, the RFID circuitry 178 can cooperate with the controller 70 to communicate via the inductor to an external source via the downline wiring, without requiring a hardwire connection to the detonator device 10.

In an illustrative example, an identification (ID) algorithm processed by an external detonation event computer utilizes an interrogation of pulse time returns from signals transmitted along a downline in combination with RFID, to identify the order of multiple detonators 10 in a corresponding hole. Additionally GPS components, e.g., as located at a hole site network box associated with the downline identifies the absolute position of the blasthole. Thus, GPS located at the hole location in combination with pulse timing and RFID, enables a determination of the location of each detonator and their relative position within a hole.

Figure 11:
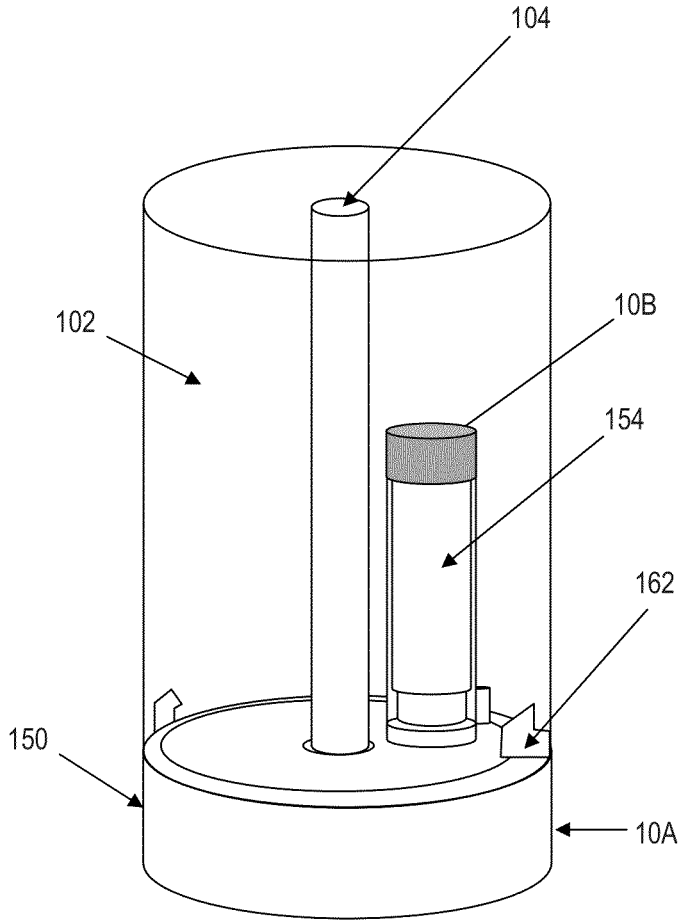
FIG. 11 is a schematic illustration of a booster interfaced with a puck shaped two-component detonator system according to various aspects of the present invention.

Referring to FIG. 11, the puck-shaped housing 150 of the NEBD 10A is mated with a cast booster 102, e.g., by sliding the detonator extension 154 into the detonator well 106 of the cast booster 102. Optional clips 162 are utilized, e.g., to align the housing 150 to the booster 102, and/or to secure the housing 150 to the booster 102.

As the detonator is loaded into the booster 102, the spring loaded detonator extension 154 takes up any gap and seats the initiator 14 into cooperation with the initiating pellet 16 of the corresponding initiating subsystem 10B. For instance, in illustrative embodiments, the take-up mechanism comprises a spring or other suitable structure that serves to register the initiator 14 and the initiating pellet 16 as described herein. In this exemplary implementation, wires pass through the tunnel 104 of the booster 102 and connect to the electronics of the NEBD 10A using a suitable connector. As an alternative, because the puck shaped housing 150 has a through passageway 152 that aligns with the through tunnel 104 of the booster 102, wiring passes through the booster and the puck-shaped housing of the NEBD 10A. Inductive components provide for wireless inductive communication from the wires passing through the detonator to the detonator processor as described in greater detail herein.

The detonator engagement mechanism, e.g., a takeup feature, is integrated directly into the detonator extension 154 rising out of the puck shaped housing 150. Under this implementation, a separate plug mechanism such as the plug 120 described with reference to FIG. 7 is not required. A specially prepared base 126 of the booster 102 is utilized to allow secure connection of an enhanced detonator with the puck-shaped housing 150 such that the takeup apparatus ensures contact of the initiator 14 with the embedded initiating pellet 16. Again, sealing provisions may also be utilized, e.g., to prevent intrusion of water into the booster's detonator well 106.

Small Sleeve Booster Using Standard Form Factor Two-Part Detonator

Small diameter holes and small diameter explosive products are often employed in the most restrictive blasting applications where ultimate control is paramount. The adaptation of the detonator device 10 to these applications will greatly expand the use of this technology in applications requiring economy, and high accuracy in products and applications requiring the utmost controlled blasting.

Figure 12:
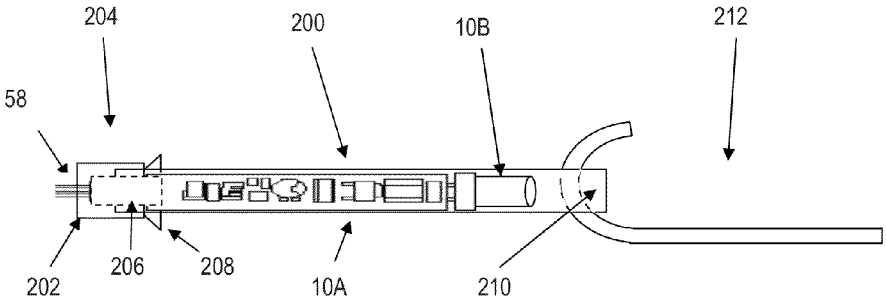
FIG. 12 is a schematic illustration of a two-component detonator system interfacing with a small booster sleeve and a detonating cord according to various aspects of the present invention.

Referring to FIG. 12, the detonator device 10, e.g., as described more fully herein with reference to FIGS. 4A-4D, may be integrated with a small booster sleeve 200. The illustrated system includes a small booster sleeve assembly 200 that contains the detonator device 10. In the illustrative example, the small booster sleeve 200 is generally tubular in shape with one open end and one closed end. As illustrated, a cradle base 202 is provided about the open end of the sleeve 200. The cradle base 202 includes an aperture that allows wiring 58 to pass through. More particularly, the cradle base 202 includes a base connector 204 that defines a takeup mechanism, a spring 206, such as a urethane spring and a clip 208.

In the illustrative arrangement, the small booster sleeve 200 includes an end adapter 210 at the closed end thereof. As such, the sleeve 200 defines a well for receiving the initiating subsystem 10B, which may be embedded therein during manufacturing. In the illustrative example, the end adapter 210 also includes a through hole for receiving a detonating cord 212, i.e., explosive filled rope or cord, typically utilized for pre-splitting applications. However, such a feature is not required. When the system is assembled, the NEBD 10A is inserted into the sleeve 200. The takeup features of the cradle base 202, including the base connector 204, spring 206 and clip 208 function to register or otherwise align the non-energetics based NEBD 10A into proper position for functioning the initiating subsystem 10B.

As described in greater detail herein, the initiating subsystem 10B comprises at least an initiating pellet 16, but may also include the initiator 14 and/or high voltage switch 12, e.g., as described in greater detail herein. Under this arrangement, the NEBD 10A interfaces with an integrated sleeve 200 having an initiating subsystem 10B including an initiator 14 and a pellet 16 built-in.

Although illustrated in the exemplary implementation for interfacing with a detonating cord 212, the detonator device 10 along with a small booster sleeve 200 may also be interfaced with other smaller, conventional explosive products such as small diameter packaged products (both cap sensitive and blasting agent), dynamites, etc. These small adapters would in effect be mini boosters and offer the same advantages of those outlined for the detonation system 10 utilizing the more conventionally sized boosters 102 as described more fully herein.

Figure 13:
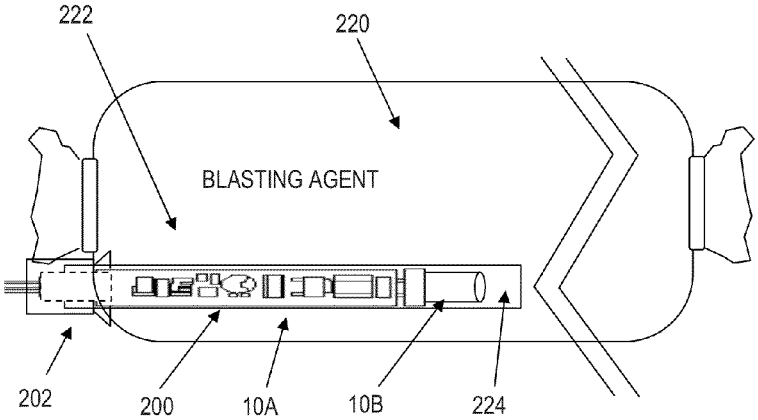
FIG. 13 is an illustration of a two-component detonator system interfacing with a blasting agent according to various aspects of the present invention.

Referring to FIG. 13, the detonator device 10 and small booster sleeve 200 are illustrated installed into a blasting agent 220. In the illustrative example of FIG. 13, the blasting agent 220 includes a detonator receiving area 222 for receiving the detonator device 10 installed in the small booster sleeve 200. In this regard, the end adapter 210 of the small booster sleeve 200 does not require a through hole for receiving a detonating cord, wire or other structure. However, the end adapter 210 is further configured to maintain a high shock output pellet 224 in cooperation with the initiating pellet 16 of the initiating subsystem 10B. The illustrated blasting agent 220 comprises, for example, a small, e.g., less than or equal to 3 inches (7.6 cm) diameter blasting product. The system is otherwise analogous to that set out with regard to FIG. 12.

According to various aspects of the present invention, the small booster sleeve 200 houses the initiating pellet and the takeup and connection end for receiving the NEBD 10A. These sleeves 110 allow insertion of the NEBD 10A before or after the sleeve 200 is inserted into a small diameter product, such as the blasting agent 220. According to further aspects of the present invention, the initiating subsystem 10B is built into the sleeve 200.

Additionally, initiator 14/initiating pellet 16 combinations can include the combination of an EFI initiator 14 with a PETN initiating pellet 16. In this case, the EFI is tuned to directly initiate a high density PETN pellet. Notably, the incorporation of a high density PETN pellet into the booster would not likely affect the hazard classification of the booster as PETN is one of the constituent materials of pentolite, a composition of the booster itself Additionally, tuning the EFI-based initiator 14 to directly initiate the PETN pellet may require a significant increase in the firing voltage and the cost of the associated components to facilitate this in the low power to high power conversion unit of the NEBD 10A. As such, an insensitive secondary such as an HNS IV pellet may be more practical to implement in certain applications.

According to yet further aspects of the present invention, an EFI-based initiator 14 is tuned to directly initiate pentolite and thus does not require an initiating pellet 16 in the booster. This would have the advantage of no special preparation of the booster. However, the stored energy and firing voltage requirements of this detonator arrangement increase significantly, which could affect the size and cost of the electronic components required to directly initiate pentolite. Additionally, the uniqueness of the NEBD 10A only working with the specially prepared boosters would be lost, and the NEBD 10A could initiate boosters from other producers.

Another illustrative example comprises an EBW initiator 14 in combination with a PETN initiating pellet 16. However, an EBW requires a low density pellet at its interface that in turn initiates a high density pellet. The low density PETN pellet would be more sensitive that a high density pellet, thus such boosters would feature both low and high density PETN pellets in the tops of their detonator wells 106.

Further, as noted in greater detail herein, the NEBD 10A is capable of performing its function in part, due to the ability of the HPCU to generate the high voltage and power required to function either an EFI or EBW. Thus, the simple inclusion of an insensitive explosive pellet in a booster, by itself, is not enough enable a working solution.

Mechanical Biasing Arrangement

Figures 14A, 14B, 14C:
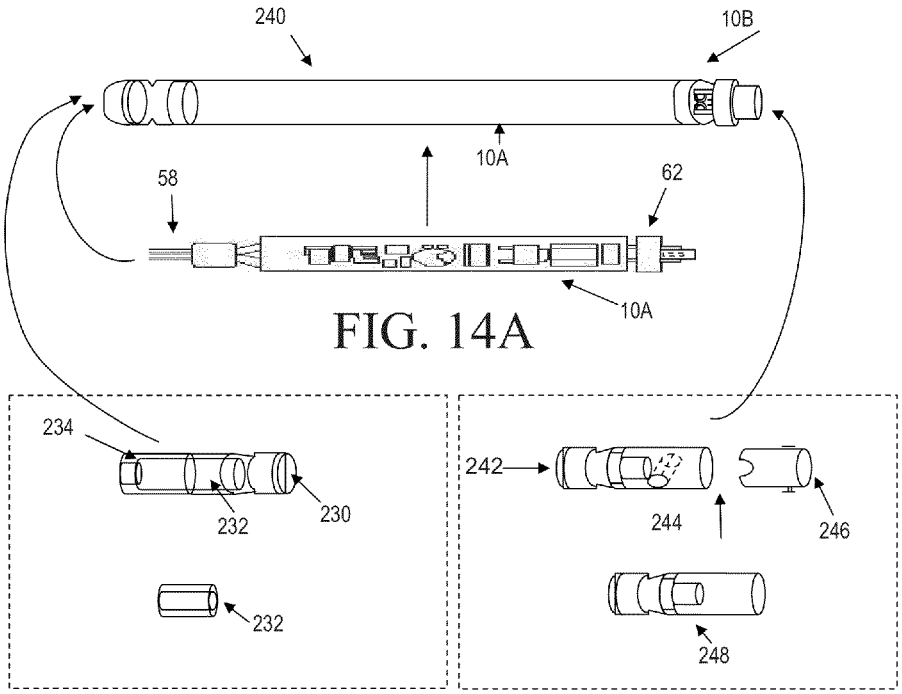
FIGS. 14A-14C are schematic illustrations of a basic two-component detonator system illustrating the utilization of adapters, according to various aspects of the present invention.

Referring to FIG. 14A-14C, an illustration is provided of a system that utilizes the detonator 10, e.g., as illustrated in FIGS. 4A-4D. The system attains the approximate shape of a conventional detonator, which is necessary for implementation in the multitude of explosive products configured for conventional detonators.

In this illustrative arrangement, the NEBD 10 is inserted into a sleeve (or a booster). A small mechanical biasing arrangement ensures the initial and continual positive engagement of the inserted NEBD 10A with a corresponding initiating subsystem 10B manufactured into an end of the sleeve (or previously installed in the sleeve). While this assembly is primarily targeted for use in specialized cast booster assemblies, versions can be employed in other adapter mechanisms for use with common explosive products.

Once the NEBD 10A is inserted into a main sleeve 240, a pusher assembly 230 is inserted behind the NEBD 10A. The pusher assembly 230 serves as part of an interface between the NEBD 10A and a spring 232, and is designed to prevent any damage to the end of the circuit board contained within the NEBD 10A. For instance, the pusher assembly 230 is utilized to transfer the compression from the foam spring 232 into the NEBD 10A assembly. In alternative arrangements, the circuit board within the NEBD 10A is embedded inside potting material, e.g., potting material 112 described with reference to FIG. 7, for protection of electronic components and to offer shock resistance of this assembly.

In an illustrative implementation, the pusher assembly 230 is provided as a two part design (see FIGS. 16A-16C) that is snapped together over the NEBD 10A communication wires. This allows attachment after the NEBD 10A has been inserted through the center tunnel of a booster, before insertion into the detonator well 106, for example. Alternatively, the pusher assembly 230 can be directly integrated into the NEBD 10A cover.

The spring 232, e.g., a tube configured foam spring, allows the passage of the communication wires through its core and compresses to provide continual force to the interface of the NEBD 10A with the initiating subsystem 10B. The moderate force of the spring 232 ensures positive engagement without damaging any of the NEBD 10A components. According to further aspects of the present invention, the spring 232 comprises a closed-cell, foam spring that is compressed by the engagement/removal component and in turn applies force to the pusher component and the NEBD 10A. The spring 232 can also serve as a sealing mechanism preventing the intrusion of dust, water, or liquids from bulk blasting agents from intruding into the detonator well of the lock in detonator assembly. This feature may also be integrated into the NEBD 10A cover.

A snap-in/removal assembly 234 is implemented, for instance, as a two-part subassembly (see FIGS. 17A-17C) that snaps over the communication wires of the NEBD 10A below the foam spring 232. Like the pusher assembly 230, the snap in/removal assembly 234 allows insertion of the NEBD 10A through the center tunnel and attachment immediately before insertion into the detonator well 106. The assembly 234 is implemented, for example, using two opposing detents with extended legs that engage a groove that is built into the interior of the booster's detonator well.

When the complete assembly (with included NEBD 10A) is inserted into the sleeve 240 (or detonator well 106 of a booster) containing an attached initiating subsystem 10B at an end thereof, the spring 232 begins to be compressed, and this continues until the detents engage the groove. The front connector on NEBD 10A separates the self-shunting legs 90 of the initiating subsystem 10B and completes electrical connection to the high voltage switch 12 and initiator 14, in a manner analogous to that described more fully herein. This "locked in" position keeps the spring 232 in continual compression. Further, detents of the engagement/removal assembly 234 snap into the grooved slot on the inside surface of the sleeve 240 (or detonator well 106), compressing the spring 232 and locking the NEBD 10A into place. The adapter back end utilizes, for instance, a machined groove around its perimeter for attachment of a securing connector. To remove the NEBD 10A from the sleeve 240 (or detonator well 106), the extended legs of the removal assembly 234 are simply pinched together to disengage the detents from the grooved slot and the NEBD 10A can then be pulled from the sleeve 240 (or booster 102).

FIG. 14B illustrates the pusher assembly 230, spring 232 and removal assembly 234 to illustrate the interaction of spring 232 between the pusher 230 and the removal assembly 234. The adapter arrangement of FIG. 14A-14B preserves the advantages of the detonator 10 described more fully herein for the basic detonator, and further expands its use in conventional explosive products, e.g., typically cap sensitive, small diameter products, detonator sensitive agents, etc.

Front Adapters

Referring to FIG. 14C, according to various aspects of the present invention, two basic front adapters (towards the initiating subsystem 10B) are provided for use with a basic detonator system as described more fully herein.

A first adapter features a one or two part plastic front adapter containing no explosives. Supported through holes in this adapter are designed for precise alignment and contact of inserted detonating cord 212 with the output end of the initiating subsystem 10B. An optional securing plug is optionally added to lock the detonating cord firmly into position. For instance, a snap-on front adapter includes a securing plug 242 that secures the end of the adapter sleeve 240. The securing plug 242 includes an interface 244 for receiving a detonating cord to pass there-through. Opposing through holes allow simple threading of detonating cord through the adapter and place the cord in direct contact with the explosive pellet in an optimum 90 degree configuration. A locking tube 246 slides over the securing plug 242 after the detonating cord is inserted through the interface 244, e.g., to secure the cord inside the adapter. An exemplary use of the embodiment illustrated in FIG. 14C is for initiating a detonating cord trunkline for an associated part of a shot, e.g., as part of an integrated presplit line.

A second adapter, also illustrated in FIG. 14C, is for an expanded length and diameter end section containing a high shock output explosive for initiating small diameter blasting agent packages. This explosive loaded adapter snaps onto the output end of the base adapter. As with the securing connector, a detent ring in this assembly engages with a groove in the top of the main adapter sleeve.

For instance, miniature booster adapter 248 is provided as an alternative to the securing plug 242, interface 244 and locking tube 246. The miniature booster adapter 248 also fits to the end of the sleeve 240 housing the initiator 10B. In the illustrative configuration, the booster adapter 248 mounts over the initiating subsystem 10B and positions the explosive pellet inside a small well in a high shock output booster explosive. Snaps are utilized in this illustrative example, over the end mounted initiating subsystem 10B, thus positioning the initiating pellet 16 of the initiating subsystem 10B inside the well of the small booster. Detents provided on the adapter seat into corresponding grooves on the main tube 240 behind the mounted initiating subsystem 10B.

The miniature booster adapter 248 is practical for the purpose of effectively initiating small diameter blasting agent packages, small diameter, booster sensitive packages, bulk blasting agents used in small diameters, etc. A high output version of the booster adapter 248 features an enlarged section at its output end, which contains a special explosive with very high shock output. The increase in explosive mass and the high shock output is used for detonating small diameter, detonator insensitive, package products, small diameter, non-cap sensitive blasting agent packages that normally require a small booster, etc.

By definition, an explosive classified as a blasting agent cannot be initiated by a standard detonator. The addition of the small booster, either inserted over the initiating subsystem 10B, or as a one-piece arrangement integrated unit over the initiating subsystem 10B, increases the explosive output of the basic configuration and expands its use for effectively detonating blasting agent grade products. In this regard, as illustrated in FIGS. 14A-14C, a complete adapter assembly is provided via a simple, snap on connection to the main tube of the sleeve 240. In an illustrative implementation, detents on the adapter seat into groove on main tube behind the mounted initiating subsystem 10B.

Figure 15A:
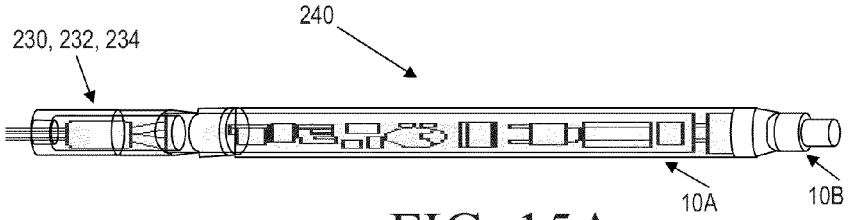
FIG. 15A-15E are schematic illustrations of a basic two-component detonator system illustrating the utilization of adapters, according to various aspects of the present invention.
Figure 15B:
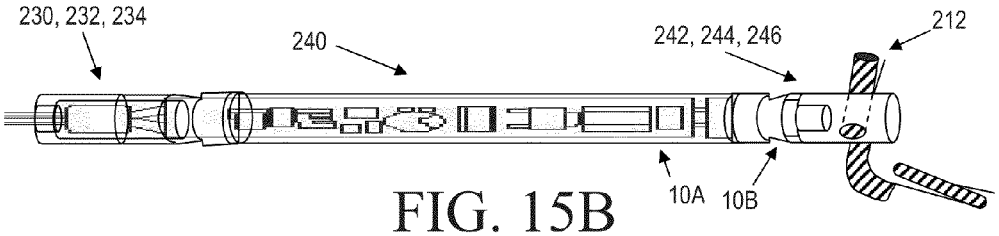
Figure 15C:
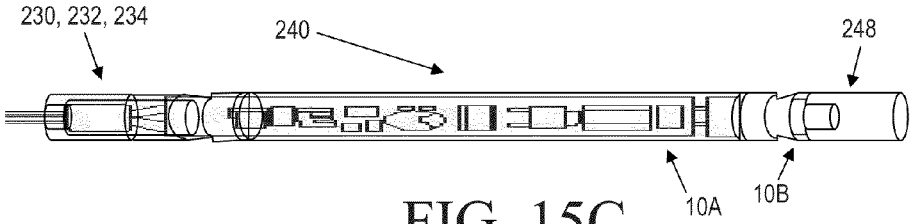
Figure 15D:
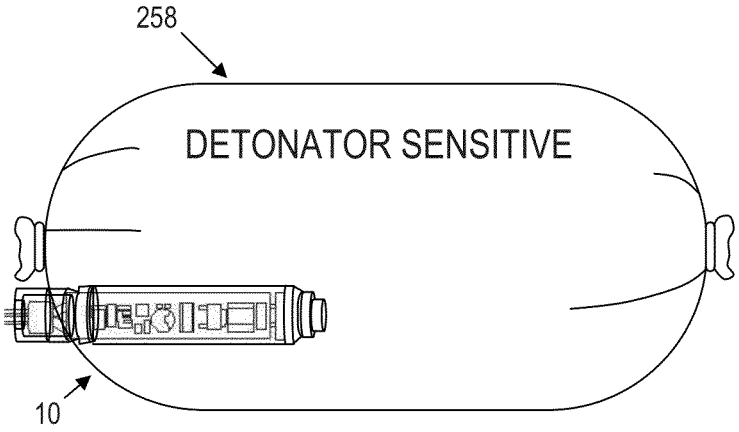
Figure 15E:
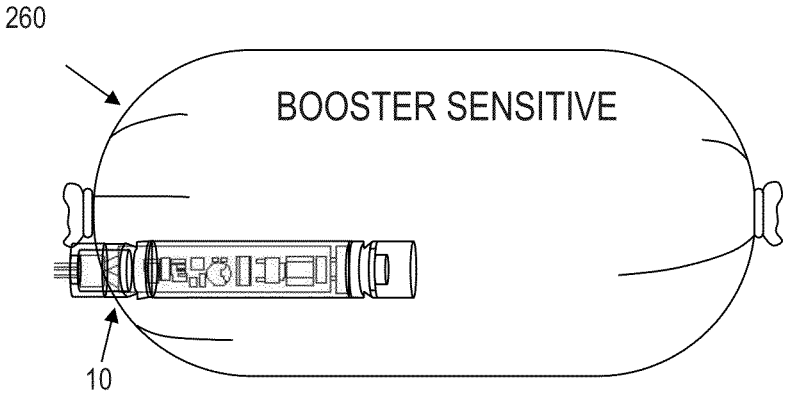

FIG. 15A illustrates the configuration of FIGS. 14A-14B in an assembled state. FIG. 15B illustrates the configuration of FIGS. 14A-14C, using the front adapter for securing to detonating cord 212. FIG. 15C illustrates the configuration of FIGS. 14A-14C using the front adapter comprising the miniature booster adapter 248. FIG. 15D illustrates the configuration of FIGS. 14A-14B installed in a detonator sensitive package. FIG. 15E illustrates the configuration of FIGS. 14A-14C installed in a booster sensitive package.

Snap-On Connectors

Figure 16A:
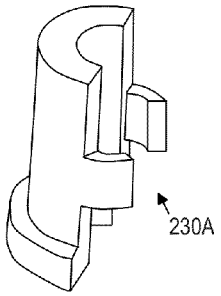
FIG. 16A is an illustration of a male half of a coupler for coupling a non-energetics based detonator to a detonation well of a booster or a sleeve, according to various aspects of the present invention.
Figure 16B:
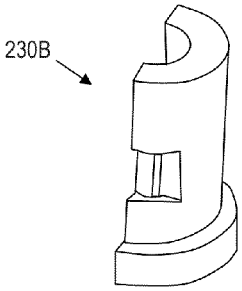
FIG. 16B is an illustration of a female half of the coupler for coupling with the male half of FIG. 16A.
Figure 16C:
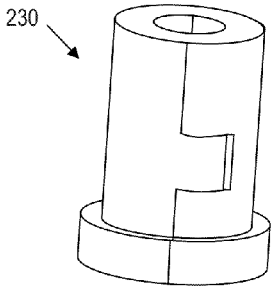
FIG. 16C is an illustration of the male and female halves of FIGS. 16A and 16B coupled together.

Referring to FIGS. 16A-16C, an 17A-17C, a clip-in connector system is illustrated, having a takeup mechanism to properly seat the initiator 14 with the pellet 16 when the NEBD 10A is mated with the initiating subsystem 10B within the sleeve 240 of FIGS. 14A-14C.

Referring initially to FIGS. 16A-16C, the exemplary implementation of the pusher assembly 230 includes a male half 230A and a corresponding female half 230B that snap together over the wires that extend from the NEBD 10A, e.g., just below the NEBD 10A board or protective tube, so as to secure the NEBD 10A into a corresponding assembly. The male half 230A features two detents on extended legs. These snap into recessed female seats on the opposing piece of the female half 230B for locking in the detents of the male half. The pusher 230 also includes an embossment that interfaces with the foam spring (232 of FIG. 14B) and is pushed by the spring into the NEBD 10A assembly. According to various aspects of the present invention, the embossment matches the diameter of the foam spring 232 to ensure efficient transfer of force and minimization of the potential to wedge the spring between the pusher assembly and the interior surface of the detonator well.

The foam spring 232 seats inside the assembled sections 230A, 230B to apply force against the inserted NEBD 10A, which ensures positive and continual engagement of the NEBD 10A with the initiating subsystem 10B mounted onto the opposite end of the main adapter sleeve 240. More particularly, when the compressed foam spring 232 pushes against an embossment at an end portion of the pusher 230, it pushes the NEBD 10A into the electrical connectors of the initiating subsystem 10B, e.g., presses against the NEBD 10A body or PCB for firmly seating the NEBD 10A interface with the legs of the initiating subsystem 10B as described more fully herein. A peripheral detent ring simply snaps into the machined groove at the base end of the main adapter sleeve.

The two component clam shell arrangement (FIG. 16A through FIG. 16C) could also be a single assembly that features a longitudinal slot to allow insertion of the leg wires of the NEBD section 10A there through.

Figure 17A:
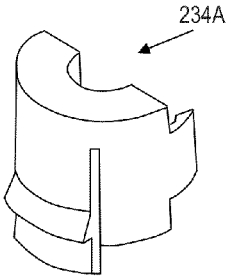
FIG. 17A is an illustration of a male half of a coupler for coupling a non-energetics based detonator to a detonation well of a booster or a sleeve, according to various aspects of the present invention.
Figure 17B:
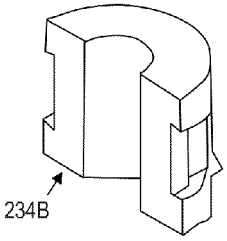
FIG. 17B is an illustration of a female half of the coupler for coupling with the male half of FIG. 17A.
Figure 17C:
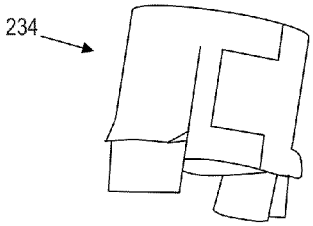
FIG. 17C is an illustration of the male and female halves of FIGS. 17A and 17B coupled together.

Referring to FIGS. 17A-17C, in an analogous fashion to the pusher 230, the removal assembly 234 includes a male half 234A and a corresponding female half 234B that snap together over the wires of the NEBD 10A just behind the foam spring so as to secure or otherwise lock the NEBD 10A within the sleeve 240 or relative to groove slot(s) (e.g., see the positioning groove 142 described with reference to FIG. 8B) inside the detonator well 106 of a booster 102. According to various aspects of the present invention, the male half 234A includes two detent extensions that snap and lock into corresponding recessed female seats in the female half 234B. The halves can be removed by prying the detent legs out of the female seat. As such, the recessed seats of female section lock the extended detents of the male section to this half.

The engaged detents secure the removal assembly 234 to the NEBD 10A and provide an anchor for providing force against the compressed foam spring 232. Thus, the removal assembly 234 compresses the foam spring and puts force onto the NEBD 10A away from the groove locations of the sleeve 240 (or booster 102) towards the initiating subsystem 10B. This force keeps the NEBD 10A firmly engaged with the electrical contacts protruding into the top of the sleeve 240 (or detonator well 106) from the back of the initiating subsystem 10B.

However, removal of the NEBD 10A assembly from the sleeve 240 (or booster 102) is accomplished by squeezing together the opposing extensions from the detents with finger pressure. This disengages the detents from the groove allowing the NEBD 10A assembly to be simply pulled out of the detonator well. For instance, in an illustrative example, two opposing leg extensions protrude slightly past the end of the sleeve 240 (or booster's detonator well). These legs disengage the detents from the sleeve 240 (or detonator well groove) when they are pinched together. This allows simple "pinch and pull" removal of the NEBD 10A from the sleeve 240 (or detonator well). This arrangement further provides the ability to easily extract a locked-in NEBD 10A from a corresponding sleeve 240 (or booster 102), should that become necessary.

The two component clam shell arrangement (FIG. 17A through FIG. 17C) could also be a single assembly that features a longitudinal slot to allow insertion of the leg wires of the NEBD section 10A there through. Additionally, the engagement and removal assembly could be an integrated feature of the NEBD 10A.

Specialized Connection Network Box

Figure 18:
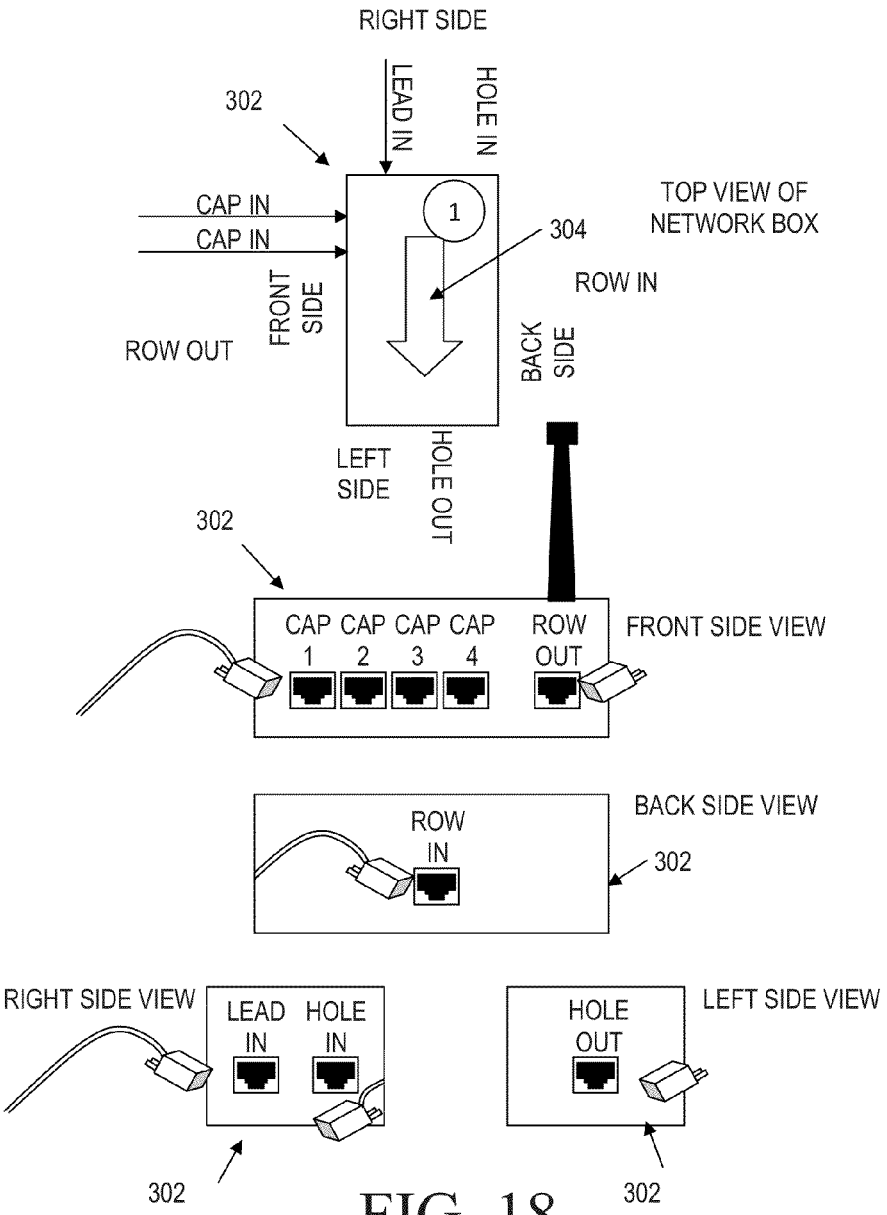
FIG. 18 is a view of a detonator computer box according to various aspects of the present invention.

Referring to FIG. 18, a detonator connection hardware (box) 302 is provided to automatically identify the relative position of all detonator devices 10 surrounding each box position. In various implementations, the utilization of such boxes, as will be described more fully herein, will not produce an exact location of each detonator device 10. However, the system will automatically produce the relative position of each detonator device 10 and associated blasthole in an array of blastholes comprising a shot.

According to further aspects of the present invention, a specialized blasting computer system completes the automatic positioning without burdening the blaster with logging each individual detonator device 10 that is loaded in a shot. This can be a significant advantage when a single shot may employ hundreds of individual detonator devices 10. For instance, in an illustrative implementation, connection boxes 302 interact with a software position analyzing algorithm, e.g., of a remote computer, to identify the relative positions of all detonators connected to the network.

The arrow 304 on the top of each connector box 302 allows for a visual check that all connection boxes 302 are placed in the same orientation. Thus, a simple process for downhole and hole-to-hole connections is provided that is fast and does not encumber the blaster with preprogramming each detonator and logging the location of the detonator in the shot. The network box approach allows a simple, low cost, relative positioning scheme to automatically determine the location of all basic type detonators in a shot. The blasting computer system then automatically assigns detonator firing times given the specific shot constraints that are input by the blaster.

The following outline describes the primary components comprising the basic system. Each component is then broken down and described in the following illustrative summary.

An at-the-hole specialists connection box 302 provides automated relative positioning of the detonators that surround each position and the relative sequential position down each hole (for multiple in-hole detonators), without the sophistication and costs of high-end electronic components like GPS. A simple alignment arrow 304 fixes the general orientation of the boxes 302 on the shot and, associatively, the due relative alignments of other shots in the system. The correct orientation perspective is looking down on the box and imagining your left foot on the tip of the arrow and your right foot on the start of the arrow. A connection on each of the box's four faces determines the presence of a next row of holes, a previous row of holes, and sequential holes within a row. Also, the number of the connections made to the downhole location determines the number and sequence of detonators within a single blasthole.

In an illustrative implementation, the connection process also makes use of color-coded connection lines and specialized connectors to further simplify connections, prevent errors, and offer an easy visual check of system hookup.

According to further aspects of the present invention, once the hardware is connected, software algorithms identify relative hole positioning without any preprogramming or logging of the detonators during the loading process with a specialized electronic logging device that is conventionally required.

As illustrated in FIG. 18, the exemplary implementation of the connection box 302 includes a front side for receiving a plurality of front side connections (e.g., up to 4 connections as illustrated) that characterize inputs from downhole detonators. Detonator connections are simply plugged into the box in the order they are loaded. The number of completed connections alerts the system to the number of downhole detonators present at that location. The color code for the connectors and associated cables is blue in an illustrative example. The front side also includes a connection that serves as an output, e.g., to the first hole in a new row of holes, i.e. a "Row Out" connection. Connecting the row out connection to a "Row In" connection on another box 302 alerts the system that an additional row of holes is present to the front of this location. Only one row connector is needed per row of holes to identify a separate row is present. Therefore, the last row in a system will not have a connection from the "Row Out." The color code for this connector and cable is yellow in the illustrative example.

A back side of the connection box 302, in the illustrative example, provides a single input from an adjacent row of holes, i.e., a "Row In" connection. This connection may be utilized, for instance, to alert the system that a row of holes exists previous to this location (typically the first hole in a previous row). As above, only one row connector is needed per row of holes to identify a separate row. Therefore, the first row in a system will not have a connection to the "Row In." The connection is designated by a yellow connector and cable in the illustrative example.

The exemplary implementation of the connection box 302 further includes a right side that receives at least one input that characterizes a single lead-in from the blasting computer. More particularly, a single lead-in line connection is present on the right side of the box. This input connection is for a single lead-in line that links the shot network to the blasting computer system. The network of connections branches out from this connection to identity all relative hole positions. The inclusion of this connection identifies this position as the starting point for all of the relative blasthole positions identified by the system, and for automated assignment of detonator firing times. The color code for this connection and cabling use in the example is white in the illustrative example.

An additional input connector is present on this side of the box for a "Hole In" connection. The completion of this connection alerts the system that a sequential blasthole location within a row precedes this location. The number of continuous "Hole In" and "Hole Out" connections determines the number of holes in a row. The lack of a completed "Hole In" connection in a particular box identifies it as the first hole in a row. This connection and cabling is identified, for example, by a green color in the illustrative example.

The exemplary implementation of the connection box 302 further includes a left side that provides a single output that characterizes an output to the next sequential hole in a row, i.e. a "Hole Out" connection. More particularly, this location is designated as a connection for the next sequential hole in a given row. The completion of this connection alerts the system that a sequential hole follows this location. This connection is identified by a green color in the illustrative implementation.

Detonator sockets on connector boxes 302 are female sockets that allow simple plug in connections and/or snap in connections of the detonator electrical connection downlines. The connection position determines the relative detonator positioning for multiple detonators in the same blasthole. The connection position identifies the cap position without manual logging. This approach improves loading time and the simplicity of using the system. Moreover, color, e.g., blue, coding of socket and cap downlines allows a simple visual check that the box connections are made and correct.

Although described herein with reference to top, front, back, right and left sides, the orientation, face and other logical and/or physical groupings of inputs and outputs can vary from that illustrated in the example.

Figure 19:
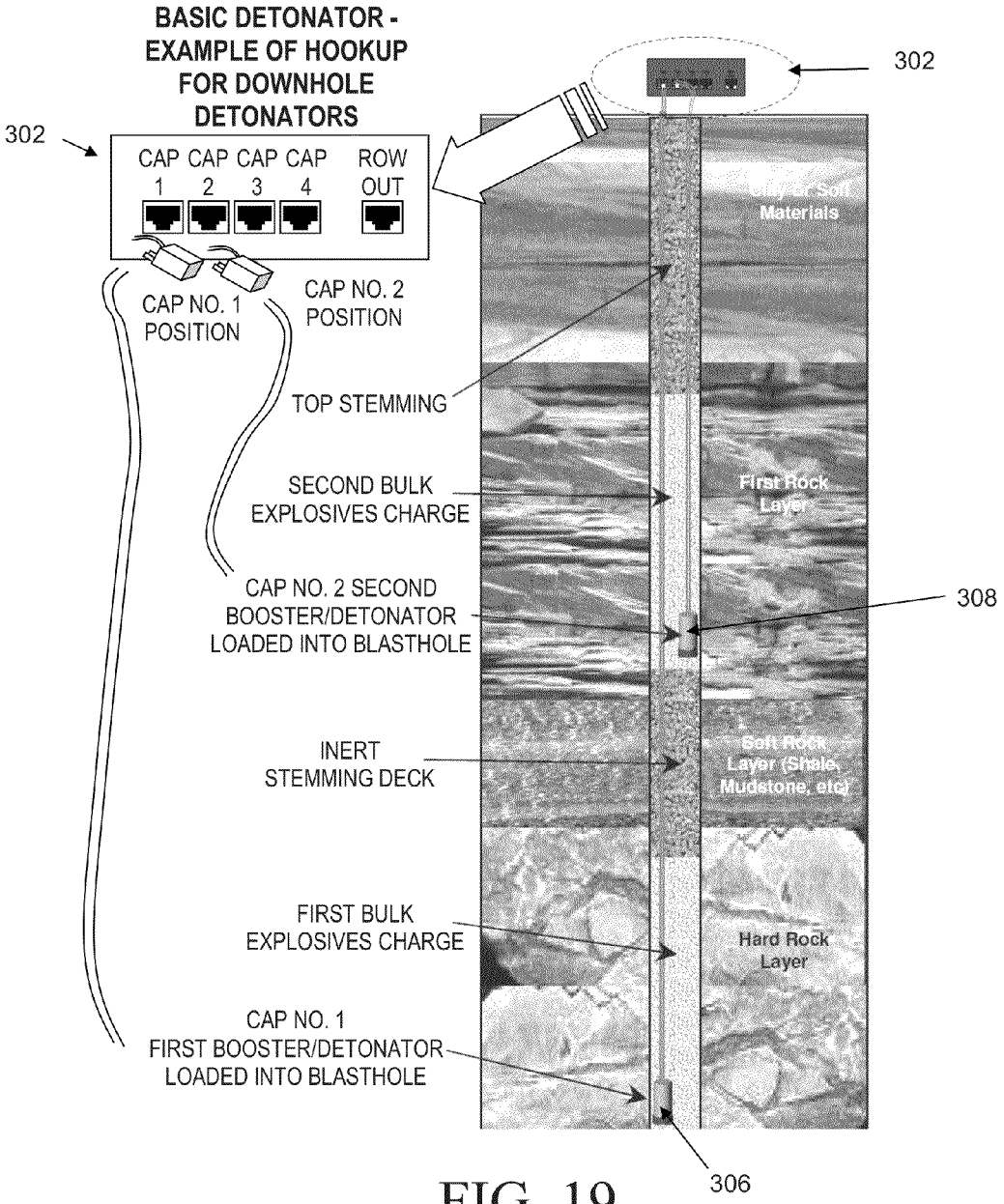
FIG. 19 is an illustration of the computer box of FIG. 18 connected to boosters and corresponding two component detonator systems according to various aspects of the present invention.

Referring to FIG. 19, the connection box 302 is illustrated as being hooked up for downhole explosives. The front side of the connection box is utilized to couple a first connection from the Cap 1 input of the connection box 302 to a first explosive 306. The first explosive 306 may comprise, for example, a detonator device 10 and a corresponding cast booster 102 as described more fully herein. A second connection is also illustrated from the Cap 2 input of the connection box 302 to a second explosive 308. The second explosive may also comprise, for example, a detonator device 10 and a corresponding cast booster 102 as described more fully herein.

More particularly, a hole is drilled into the ground. The illustrated hole is drilled through a clay or soil materials layer (overburden), through a first rock layer, through a soft rock layer and into a hard rock layer. The first explosive 306 is loaded down the hole into the hard rock layer. Next, a bulk explosive charge is then filled into the hole. About the soft rock layer, an inert stemming layer is utilized to backfill the hole. The second explosive 308 is positioned in the hole about the first rock layer. Again, a bulk explosive charge is utilized to continue to back fill the hole up to about the clay layer, wherein an inert top stemming layer is utilized to continue to fill the hole.

Figure 20:
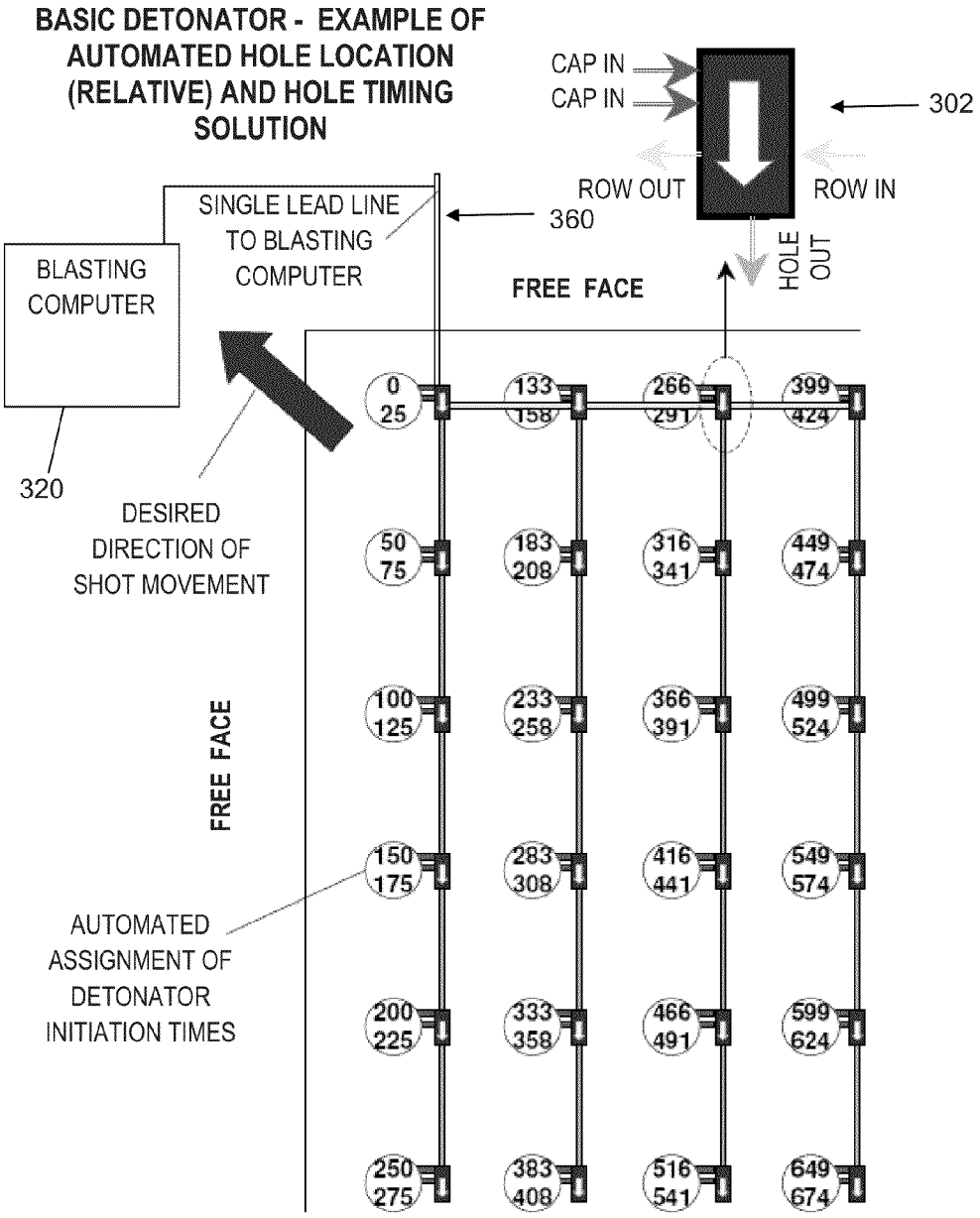
FIG. 20 is an illustration of an exemplary blasting site with an illustrative timing solution, according to various aspects of the present invention.

Referring to FIG. 20, the wiring from the connector boxes 302 is coupled to a blasting computer system 320. The blasting computer system 320 is a specialized computer-based hardware and software system that serves as the intelligence center of the system. According to various aspects of the present invention, a single lead-in line connects the blasting computer system 320 with all detonators 10 in the connected shot network. The hardware connections completed in the network boxes 302 and specialized software algorithms determine the relative positions of all detonators 10 present in the shot and display them as an array of hole locations. Multiple downhole detonators 10 are displayed as multiple ID numbers within a hole. The system then prompts the user for a series of inputs required to establish the constraints for a computed shot time solution, i.e., firing sequence for multiple in-hole detonators 10, taking into consideration factors such as explosive charge weight associated with each detonator, distance to nearest protected structure, desired timing pattern type, etc.

A software algorithm then solves the shot timing problem given the constraints and the variables (e.g., number of holes and detonators per hole). The user can then accept the computed solution or modify the solution. The automatic relative hole positioning and automated timing solutions generated by the blasting computer system 320 (as optionally modified by the user) can be incorporated along with specific shot inputs as a unique attribute of the system that will save significant time required for loading a shot with current electronic or conventional detonators, as well as reduce user error in properly executing a shot. This system allows the blaster to concentrate on loading the shot (proper type and quantity of explosive in each hole or independent charge) with all of the associated detonator positioning identified after the shot is loaded and hooked up. Thus, hardware and optional user data are utilized for calculating a proper shot timing solution that is bounded by the input data.

This scheme does not make use of advanced positioning instruments like GPS, but rather, determines locations of the detonators by the specific connections that are made to the boxes 302, and a software algorithm determines the relative positions of the detonators 10. This method does not require connections to a logger to preprogram the detonator or log its position during the shot loading process. The detonator devices 10, as described more fully herein, are loaded in the holes like standard detonators. Their wires are simply "clicked" into the appropriate positions on the box 302. When the lead line to the network is connected to the blasting computer 320, all of the relative positioning is determined and firing times are assigned according to other variables input by the user.

The following few paragraphs illustrate setting up a system for detonation. The system collects input data from the system hardware along with user defined input for calculating a proper shot timing solution that is bounded by the input data. As noted in greater detail above, an automated, software based shot timing solution is derived from system hardware and user input.

The system performs automated relative blasthole positioning by using a network box connection scheme and scanning software algorithm to determine the relative positions of all blastholes in the shot automatically. Simple, hardwired, non-GPS based methods are utilized for identifying relative (not absolute) blasthole positioning. This approach does not require the recording of each detonator position with a separate hole logger. Further, this approach does not require any preprogramming of detonator by logger.

Then, a user defines timing patterns for a blasting solution. In an illustrative implementation, the user selects timing patterns from a list, the user may also custom define timing patterns, etc. Since the computer system cannot know the physical constraints governing a shot, this user-selected input information defines, for example, the desired shot movement that is produced by the timing scheme. In this regard, the user defined timing pattern information is utilized to direct the particular method that the software employs for the blasting solution. For instance, in illustrative implementations of the present invention, the user selects a timing pattern from menu of shot timing schemes. According to further aspects of the present invention, the user establishes user-defined timing criteria, e.g., to accommodate a specialized condition.

Next, the system receives user-defined restrictions, if required. For instance, it may be required that restrictions be in place to protect nearby structures. The distance to the nearest protected structure may be a primary consideration for a shot timing solution. Government standards regarding scaled distances and maximum blasting induced vibration levels are specified at the closest, non-mine owned structures. An optimum shot timing solution must maintain independent (e.g., >=8 ms) initiation of each charge(s) up to and not exceeding the maximum pounds-of-explosive-per-delay-interval. Thus, in illustrative implementations, the user is able to enter the distance to the nearest protected structure, which is factored into the blasting solution. The user may also be able to enter a desired scaled distance, maximum vibration level, or both. The software will report if attaining desired/required limits are possible. In this regard, the shot timing software optionally further interfaces with vibration prediction software to determine a likelihood of success in achieving blasting goals.

The system then processes loading variables. User-defined input is provided to the blasting computer, e.g., for single holes, a group of holes, or a representative hole for the entire shot (all holes are the same depth loaded the same way). This defines the order in which multiple in-hole detonators are to be fired and the associated explosive quantity for each detonator. This may be of relevance for defining the timing solution to meet the previously input vibration constraints. According to various aspects of the present invention, system software automatically displays all of the holes in the shot for the user from the hardware wiring inputs. The user can then select a single, groups, or all of the holes in the shot using an input device, e.g., a mouse, to define the specific hole loading attributes and the sequence that multiple in-hole detonators are to be fired (e.g., top to bottom).

The blasting computer performs the necessary computations to implement the desired blasting operation. As noted in greater detail herein, a specialized software algorithm is utilized to compute the blasting solution. The output and shot timing solution are output to provide a shot timing solution given the hardware data and user input data. A proposed timing solution can be user modified for specific constraints. The blasting computer 320 programs the individual detonators 10A to the accepted solution and executes the solution upon user command to initiate a detonation event. For instance, the blasting computer 320 communicates with the control electronics such as the controller 18 (FIG. 2); controller 52 (FIG. 4A) controller 70 (FIG. 4B) etc., in the NEBD 10A, to program the corresponding detonator systems 10.

As such, the system networks all detonators to the blasting computer system for identification and also performs powering, programming, and firing of the detonator devices 10. Software links the hardwired devices to the user input data to compute a shot-firing solution. The computer then programs, powers the detonators, and executes the specified shot initiation scheme under user command. Associated hardware links provide automated detonator positions. Moreover, the blasting computer 320 is optionally utilized to supply a low voltage energy source to the detonator systems 10, that is converted to high voltage in each networked NEBD 10A to function the detonator, as described more fully herein.

With continued reference to FIG. 20, a schematic diagram illustrates an example of automatic blasthole location and hole timing solutions. As illustrated, a single lead line 360 extends from the blast area to the blasting computer 320. In the illustrated example, a blast is timed to move towards the upper left as looking into the sheet. Moreover, each circle represents a pair of detonators 10, e.g., arranged in the holes such as illustrated and described with reference to FIG. 19. In this regard, the computer 320 computes a shot time for each detonator, as shown in the respective circles. The computer 320 communicates across the lines directly to the detonators 10, e.g., identifying each detonator system 10 by an identification. In an illustrative implementation, the identification is controlled or otherwise established by the controller 18 of each NEBD 10A, which is communicated to the computer 320. Alternatively, other identification schemes can be implemented. Regardless, each detonator device 10 receives the detonation information from the blast computer 320 and loads the necessary timing into its internal control electronics to perform the desired blasting operation.

Figure 21:
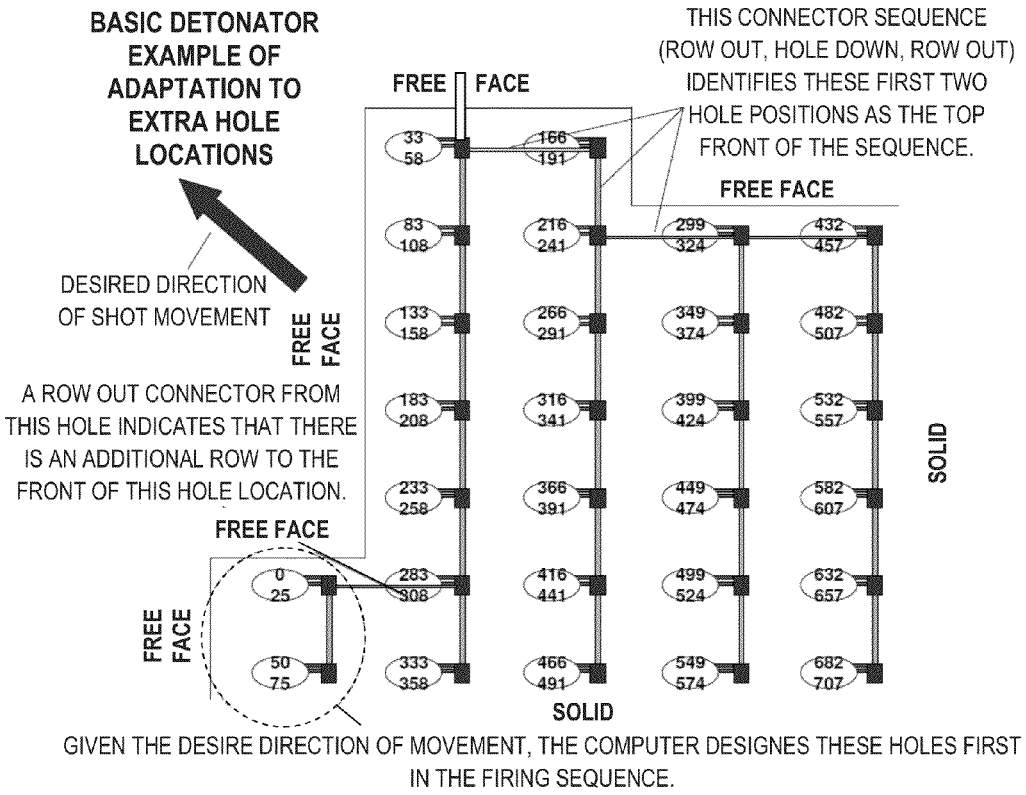
FIG. 21 is an illustration of another exemplary blasting site with an illustrative timing solution, according to various aspects of the present invention.

Referring to FIG. 21, the arrangement is analogous to that described with reference to FIG. 20. However, the free face geometry may not be a simple shape as in FIG. 20. However, the programming of the firing times (shown in circles) of each detonator device 10 is analogous.

The network connection method is primarily intended for use with the basic form of the detonator device 10, described more fully herein. In this regard, the network connection method provides relative hole/detonator position without the need for sophisticated electronics like GPS. As such, the network connection method described more fully herein requires hole to hole connections that may be eliminated, for example, with more complex systems, such as those that work with an enhanced version of the detonator system 10, e.g., with detonators that have global positioning (GPS) capabilities.

For instance, as described more fully herein, enhanced versions of the detonator system 10 are capable of inductive communication, which allows multiple detonator/boosters on a single downline with only one connection to the network box at the top of the hole regardless of the number of detonators 10 used. In contrast, the basic system illustrated in FIGS. 18-21 requires a sequential connection for each detonator 10 to a box 302 in the order that it is loaded into the hole. Additionally, the enhanced system may utilize wireless connections between each hole and can communicate wirelessly with a "shot controller" that could be hardwired back to the blasting computer. In this regard, the wireless capability lies at the shot controller, not each individual detonator, per se.

In yet a further implementation, GPS circuitry is located into the network box 302, independent of the detonator(s). This provides more precise information about the location of the network boxes 302 to the blast computer 320.

Still further, according to aspects of the present invention, wireless communication is used only on the shot bench, resulting in a very short range to ensure reliability. The operation advantage of this configuration is that all of the time (and associated costs) of hard wiring in each individual detonator is eliminated and exact hole and detonator location (via GPS and inductively enabled RFID) is relayed back to the blasting computer. By contrast, although it is a reasonably simple process, each individual hole in the basic system network still needs to be hardwired into the various network boxes. The advantage of hardwiring however, is the relative hole location is automatically determined at the blasting computer, allowing application of automated shot timing algorithms. While more labor-intensive to enact than a wireless system, this connection approach eliminates the complications and mistakes that can occur with other systems.

Miscellaneous

Regulations currently restrict the way that conventional detonators are stored, transported and handled. Such regulations arise from the hazards associated with the explosive materials (typically, a primary explosive and a secondary explosive) that are contained in these detonators. However, according to aspects of the present invention, the NEBD 10A does not include any explosives, and should thus avoid regulations on transporting explosives. However, according to various aspects of the present invention, the utilization of detonator devices 10 as set out herein can reduce or eliminate the restrictions imposed upon users with regard to storage, handling and transportation of detonators as such regulations are specific to the explosives contained therein, and no explosives are utilized in the NEBD 10A. For instance, according to further aspects of the present invention, the initiating subassembly 10B can be integrated into a booster or other explosive device such that the initiating subsystem 10B is kept separate from the NEBD 10A, which contains no explosives.

Embedding the initiating subsystem 10B into a corresponding booster, e.g., permanently at the time of manufacture of the booster, would not change the hazard class of the booster as the initiating pellet of the initiating subsystem 10B may comprise a secondary explosive such as Hexanitrostilbene (HNS-IV) or a constituent of the booster, such as pentaerythritol tetranitrate (PETN). That is, the initiating pellet of the initiating subsystem 10B likely includes explosives that are the same as, or less sensitive than the explosives already provided in the booster. As such, current methods of transporting, storing, and using cast boosters for the commercial blasting industry would not change.

Moreover, according to various aspects of the present invention, the NEBD 10A would not directly function a conventional booster or other explosive products because it does not contain any initiating explosives. As such, detonator devices 10 described more fully herein, are believed to offer anti-terror, anti-theft benefits because the clandestine acquisition or theft of the NEBD 10A without the mating initiating subsystem 10B is useless for employment with conventional explosives.

Conversely, the booster having an integrated initiating subsystem 10B described more fully herein, could be functioned with any common detonator as conventional detonators contain their own initiating technology and initiating explosives. This configuration provides a unique chain of possession advantage because the non-energetics based detonators 10A are rendered essentially useless without the corresponding boosters having the associated initiating subsystems 10B. Integration of the initiating subsystem 10B with a corresponding booster is set out in greater detail herein.

The Non-Energetics Based Detonator system 10 can also be used in oil well applications in a very similar mode as mining applications. In this mode, the initiating subsystem 10B, e.g., the explosive pellet 16 and EFI chip (e.g., switch 12 and initiator 14), are embedded in an explosive perforating charge or a perforating gun detonation cord line. The NEBD 10A is plugged into the initiating subsystem 10B in a manner analogous to that described above, including with reference to the mining applications. In certain illustrative implementations, the plug-in portion of the detonator 10, is modified to allow for the detonator to be at an angle (e.g., 90 degrees) to the explosive perforating charge to allow for more room inside the pipe diameter by simply modifying the orientation of the connection slots.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present invention has been presented for purposes of illustration and description, but is not intended to be exhaustive or limited to the invention in the form disclosed. Many modifications and variations will be apparent to those of ordinary skill in the art without departing from the scope and spirit of the invention.

Having thus described the invention of the present application in detail and by reference to embodiments thereof, it will be apparent that modifications and variations are possible without departing from the scope of the invention defined in the appended claims.

What is claimed is:

1. A detonator for initiating a detonation event, comprising:

a non-energetics based subsystem that is free of explosive material, having:

a controller;

a low voltage to high voltage converter controlled by the controller;

a primary energy source coupled to the low voltage to high voltage converter;

a secondary energy source controlled by the controller;

a first interface having:

a first pair of conductive contacts spaced by an insulator, where each of the conductive contacts of the first pair is electrically coupled to a circuit path associated with the primary energy source; and a second pair of conductive contacts spaced by the insulator, where each of the conductive contacts of the second pair is electrically coupled to a circuit path associated with the secondary energy source; and an initiating subsystem that is selectively coupled or uncoupled from the non-energetics based subsystem, having:

a high voltage switch;

an initiator electrically coupled in series with the high voltage switch;

an initiating pellet positioned in cooperation with the initiator, having explosive material comprising at least one insensitive secondary explosive material, wherein the explosive material is free of sensitive primary explosive material and is positioned such that functioning the initiator detonates the explosive material of the initiating pellet; and a second interface having:

a first pair of interface legs that mate with the first interface to electrically couple the circuit of the high voltage switch and initiator with the primary energy source; and a second pair of interface legs that mate with the first interface to electrically couple a control element of the high voltage switch with the secondary energy source;

wherein:

the first pair of interface legs of the second interface are self-shunting and thus short to one another when the initiating subsystem is removed from the non-energetics based subsystem;

the second pair of interface legs of the second interface are self-shunting and thus short to one another when the initiating subsystem is removed from the non-energetics based subsystem; and the insulator of the first interface is arranged so as to separate the first pair of self-shunting legs and guide each leg to a corresponding one of the first pair of conductive contacts, and separate the second pair of self-shunting legs and guide each leg to a corresponding one of the second pair of conductive contacts, when the non-energetics based subsystem is suitably assembled with the initiating subsystem by mating the first interface with the second interface.

2. The detonator according to claim 1, wherein the second interface of the initiating subsystem further comprises:

a mounting body that serves as an alignment fixture to align the initiator with the initiating pellet, the mounting body having:

a first holder that secures the initiating pellet to the mounting body; and a second holder that secures the initiator and high voltage switch;

wherein the first holder mates with the second holder.

3. The detonator according to claim 1, wherein:

the first holder defines a top disk having a pellet cup to hold the initiating pellet and a barrel feature for aligning the initiator with the initiating pellet; and the second holder comprises:

a chip nest that holds the initiator and high voltage switch, and a feature that couples the electrical connections from the first interface of the non-energetics based subsystem to the initiator seated in the second holder.

4. The detonator according to claim 1, wherein:

the initiating subsystem mated with the non-energetics based subsystem takes on the form factor of a conventional detonator.

5. The detonator according to claim 1, further comprising:

a booster of explosive material having a detonation well, wherein:

the initiating subsystem is fixedly installed generally towards the top of the detonation before the non-energetics based subsystem mates with the initiating subsystem by inserting the non-energetics based subsystem into the detonation well so as to mate each interface leg with its corresponding conductive pad.

6. The detonator according to claim 5, wherein:

the detonator well comprises:

a seat recessed back into the detonator well for seating the initiating subsystem; and an alignment feature that guides the non-energetics subsystem into the detonator well so as to align and properly mate the inserted non-energetics subsystem with the initiating subsystem installed into the detonator well.

7. The detonator according to claim 1, wherein:

the non-energetics based subsystem is packaged in a puck-shaped housing dimensioned to mate with a cast booster, the puck shaped housing having:

an aperture there through that aligns substantially in register with the through aperture of the corresponding cast booster when a cast booster is integrated with the non-energetics based subsystem.

8. The detonator according to claim 7, wherein:

the puck-shaped housing further comprises a spring biased takeup provided on an extension that is dimensioned to register with a detonator well of the cast booster when a cast booster is integrated with the non-energetics based subsystem.

9. The detonator according to claim 8, further comprising:

an inductive core comprising at least two through tunnels built into the detonator puck-shaped housing, which are utilized for inductive linking and communication; and an inductor proximate to at least one through tunnel having a through hole generally coaxial with the corresponding through tunnel, which serves as an inductive pickup for communication with associated circuitry.

10. The detonator of claim 1, further comprising:

a sleeve that sleeves the detonator such that the initiating subsystem is located at one end thus defining a closed end of the sleeve and the non-energetics based subsystem is located towards an open end of the sleeve;

an adapter for interfacing with an explosive material located at the closed end of the sleeve in cooperation with the initiating subsystem;

a cradle base at the open end of the sleeve having an aperture for wiring to pass from outside the sleeve to the non-energetics based subsystem; and a takeup in cooperation with the cradle base having a spring that urges an initiator of the non-energetics based subsystem into mating contact with the initiating subsystem.

* * * * *

UNITED STATES PATENT AND TRADEMARK OFFICE

CERTIFICATE OF CORRECTION

PATENT NO. : 8,661,978 B2
APPLICATION NO. : 13/717970
DATED : March 4, 2014
INVENTOR(S) : Roger F. Backhus et al.

It is certified that error appears in the above-identified patent and that said Letters Patent is hereby corrected as shown below:

In the Claims:

Column 36, line 57, "according to claim 1, wherein" should read --according to claim 2, wherein--.

Signed and Sealed this
Twenty-seventh Day of May, 2014

Michelle K. Lee

Michelle K. Lee
*Deputy Director of the United States Patent and Trademark Office*